US010496017B2

(12) United States Patent
Hozumi

(10) Patent No.: US 10,496,017 B2
(45) Date of Patent: Dec. 3, 2019

(54) BELT DEVICE, INTERMEDIATE TRANSFER DEVICE, AND IMAGE FORMING APPARATUS

(71) Applicant: Yoshiki Hozumi, Kanagawa (JP)

(72) Inventor: Yoshiki Hozumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/918,716

(22) Filed: Mar. 12, 2018

(65) Prior Publication Data

US 2018/0267437 A1 Sep. 20, 2018

(30) Foreign Application Priority Data

Mar. 17, 2017 (JP) ..... 2017-053758

(51) Int. Cl.
*G03G 15/01* (2006.01)
*G03G 15/16* (2006.01)

(52) U.S. Cl.
CPC ..... *G03G 15/1615* (2013.01); *G03G 15/0136* (2013.01)

(58) Field of Classification Search
CPC ..... G03G 15/1615; G03G 15/0136
See application file for complete search history.

(56) References Cited

U.S. PATENT DOCUMENTS 6,321,052 B1 * 11/2001 Yamashina ..... G03G 15/167 399/165
2007/0003336 A1 1/2007 Ninomiya et al.
2011/0085834 A1 4/2011 Naruse et al.
2011/0103822 A1 5/2011 Sugiura et al.
2011/0158677 A1 6/2011 Kikuchi et al.
2011/0229187 A1 9/2011 Hozumi et al.
2011/0229234 A1 9/2011 Hozumi et al.
2012/0008973 A1 1/2012 Sakakibara et al.
2012/0034006 A1 2/2012 Asaoka et al.
2012/0087704 A1 4/2012 Asaoka et al.
2012/0099883 A1 4/2012 Kikuchi et al.
2013/0315617 A1 11/2013 Sugiura et al.
2014/0008184 A1 1/2014 Hozumi et al.
2014/0147181 A1 5/2014 Sugiura et al.
2015/0117914 A1 4/2015 Hozumi et al.
2015/0125189 A1 5/2015 Hozumi et al.
(Continued)

FOREIGN PATENT DOCUMENTS

JP 08127448 A * 5/1996
JP 2001175100 A * 6/2001
(Continued)

*Primary Examiner* — Walter L Lindsay, Jr.
*Assistant Examiner* — Milton Gonzalez
(74) *Attorney, Agent, or Firm* — Duft & Bornsen, PC

(57) ABSTRACT

A belt device includes a plurality of support rotators, a belt, a rotator inclination unit, a belt tension adjuster, and a descent stopper. The belt is looped around the plurality of support rotators and rotated by rotation of the plurality support rotators. The rotator inclination unit inclines a rotation axis of a first support rotator of the plurality of support rotators relative to a rotation axis of another support rotator of the plurality of support rotators that is different from the first support rotator. The belt tension adjuster adjusts tension of the belt, and the descent stopper prevents the first support rotator from descending.

10 Claims, 25 Drawing Sheets

(56) References Cited

U.S. PATENT DOCUMENTS

| | | | |
|---|---|---|---|
| 2015/0227089 | A1 | 8/2015 | Hozumi et al. |
| 2015/0301484 | A1 | 10/2015 | Hozumi et al. |
| 2016/0062279 | A1 | 3/2016 | Hozumi et al. |
| 2016/0139553 | A1 | 5/2016 | Hozumi et al. |
| 2016/0251166 | A1 | 9/2016 | Hozumi et al. |
| 2017/0242387 | A1 | 8/2017 | Hozumi et al. |

FOREIGN PATENT DOCUMENTS

| | | | | |
|---|---|---|---|---|
| JP | 2005227455 | A | * | 8/2005 |
| JP | 2007-093642 | | | 4/2007 |
| JP | 2014-010429 | | | 1/2014 |

* cited by examiner

BELT DEVICE, INTERMEDIATE TRANSFER DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2017-053758, filed on Mar. 17, 2017, in the Japan Patent Office, the entire disclosure of which is hereby incorporated by reference herein.

BACKGROUND

Technical Field

This disclosure generally relates to a belt device, an intermediate transfer device, and an image forming apparatus, such as a copier, a printer, a facsimile machine, or a multifunction peripheral having at least two of copying, printing, facsimile transmission, plotting, and scanning capabilities.

Related Art

There is a belt device that includes an endlessly moving belt looped around a plurality of rollers. One of the plurality of rollers is inclined relative to the other roller.

SUMMARY

According to an embodiment of this disclosure, an improved belt device includes a plurality of support rotators, a belt, a rotator inclination unit, a belt tension adjuster, and a descent stopper. The belt is looped around the plurality of support rotators and is rotated by the plurality support rotators. The rotator inclination unit inclines a rotation axis of a first support rotator of the plurality of support rotators relative to a rotation axis of another support rotator of the plurality of support rotators that is different from the first support rotator. The belt tension adjuster adjusts tension of the belt, and the descent stopper prevents the first support rotator from descending.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
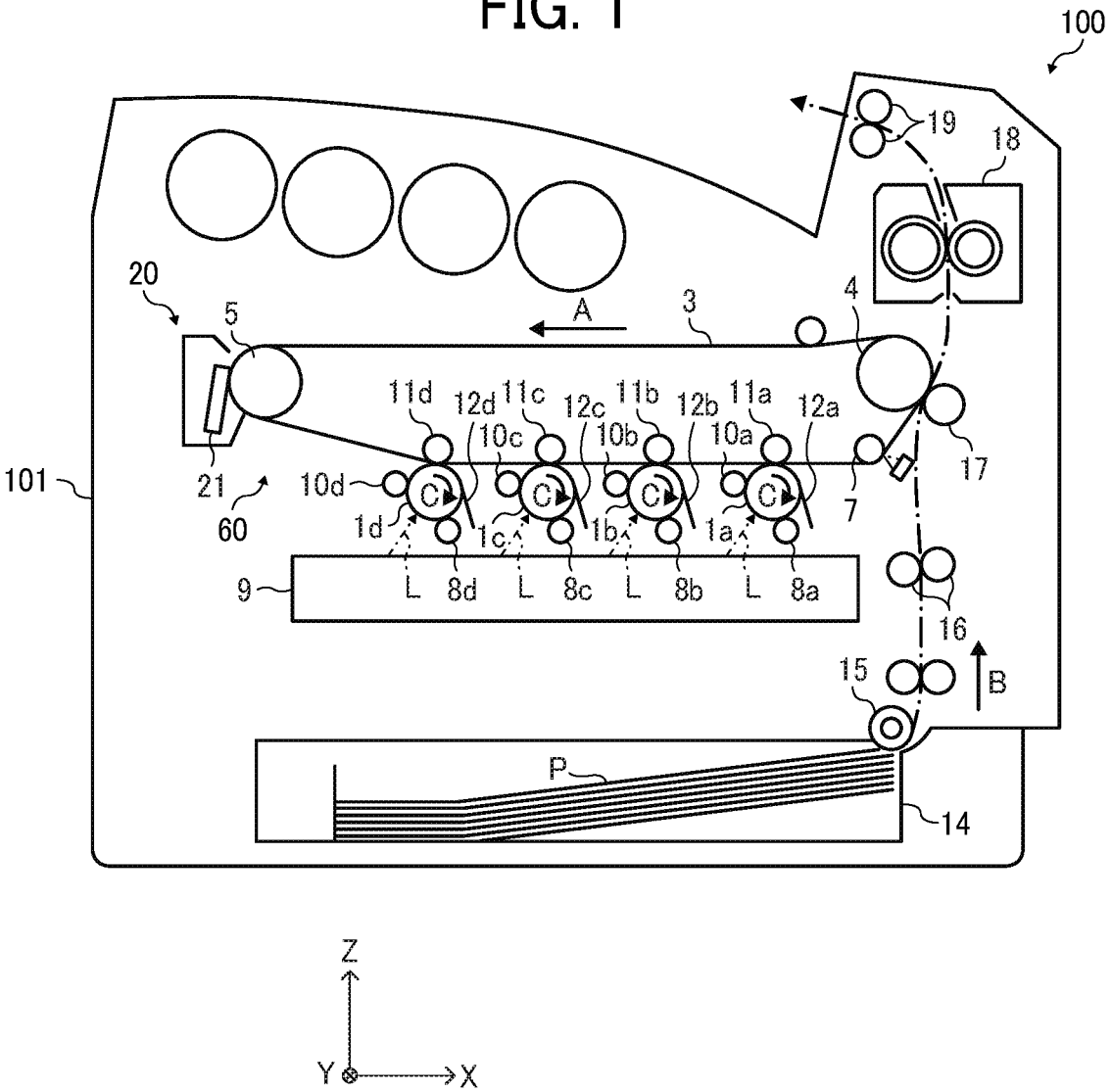
FIG. 1 is a schematic view of a printer as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Descriptions are given below of an electrophotographic color printer (hereinafter, simply referred to as "printer") as an example of an image forming apparatus according to an embodiment of the present disclosure. A basic configuration of a printer 100 is described below.

FIG. 1 is a schematic view of the printer 100 according to one embodiment of the present disclosure. The printer 100 is a tandem type color printer and includes four photoconductors 1*a*, 1*b*, 1*c*, and 1*d* (hereinafter, also collectively referred to as "photoconductors 1") as image bearers in an apparatus body housing 101. A belt device in the form of an intermediate transfer device 60 that includes an intermediate transfer belt 3 is disposed above the four photoconductors 1. The intermediate transfer device 60 is removably installable in an apparatus body of the printer 100.

Toner images of different colors are formed on the four photoconductors 1*a*, 1*b*, 1*c*, and 1*d*, respectively. More specifically, black toner images, magenta toner images, cyan toner images, and yellow toner images are formed on the photoconductors 1*a*, 1*b*, 1*c*, and 1*d*, respectively. As illustrated in FIG. 1, the photoconductors 1 are drum-shaped. Alternatively, the image forming apparatus can employ, as photoconductors, endless belts entrained around a plurality of rollers and driven to rotate.

In the intermediate transfer device 60, the intermediate transfer belt 3 as an intermediate transferor is disposed so as to face the photoconductors 1*a*, 1*b*, 1*c*, and 1*d*. In a state illustrated in FIG. 1, the photoconductors 1*a*, 1*b*, 1*c*, and 1*d* are in contact with a surface of the intermediate transfer belt 3. The intermediate transfer belt 3 illustrated in FIG. 1 is looped taut around a plurality of support rotators, such as a secondary transfer backup roller 4, a tension roller 5, and an entry roller 7. As a drive source drives the secondary transfer backup roller 4 as a driving roller, which is one of the support rotators, the intermediate transfer belt 3 rotates in the direction indicated by arrow A in FIG. 1.

The intermediate transfer belt 3 is either a multi-layer belt or a single-layer belt. In the case of the multi-layer belt, the intermediate transfer belt 3 preferably includes a base layer formed of a material, such as fluoroplastic, polyvinylidene fluoride (PVDF) sheet, or polyimide resin, that is less stretchy, and a smooth coat layer formed of, for example, fluoroplastic covers the surface of the intermediate transfer belt 3. In the case of the single-layer belt, the intermediate transfer belt 3 is preferably made of, for example, polyvinylidene fluoride (PVDF), polycarbonate (PC), polyimide (PI), or the like.

Regardless of the color of toner, the configuration and operation to form toner images on the photoconductors 1*a*, 1*b*, 1*c*, and 1*d* are similar. Similarly, the configuration and operation to transfer the toner images onto the intermediate transfer belt 3 are similar regardless of the color of toner. Accordingly, a description is given of the configuration and operation to form black toner images on the photoconductor 1*a* disposed most downstream of the intermediate transfer belt 3 in a direction of movement of the intermediate transfer belt 3 (hereinafter, referred to as "belt moving direction") and transfer black toner images onto the intermediate transfer belt 3 as representative. Descriptions of the configuration and operation regarding other colors are omitted to avoid redundancy.

The photoconductor 1*a* for black rotates clockwise indicated by arrow C in FIG. 1. As a discharger irradiates a surface of the photoconductor 1*a* with light, a surface potential of the photoconductor 1*a* is initialized. A charger 8*a* uniformly charges the initialized surface of the photoconductor 1*a* to a predetermined polarity (in the present embodiment, negative polarity). Subsequently, an exposure device 9 irradiates the charged surface of the photoconductor 1*a* with a modulated laser beam L, thereby forming an electrostatic latent image corresponding to writing data on the surface of the photoconductor 1*a*. According to the printer 100 in FIG. 1, the exposure device 9 is a laser writing device that emits the laser beam L. Alternatively, the exposure device can include a light-emitting diode (LED) array and an imaging device.

When the electrostatic latent image on the photoconductor 1*a* passes a developing device 10*a* for black, the electrostatic latent image is developed with black toner into a visible image. Primary transfer roller 11*a* for black is disposed inside the looped intermediate transfer belt 3, facing the photoconductor 1*a* via the intermediate transfer belt 3. The primary transfer roller 11*a* contacts a back surface of the intermediate transfer belt 3 to form a primary transfer nip between the photoconductor 1*a* and the intermediate transfer belt 3.

A primary transfer voltage opposite to charging polarity of the toner image on the photoconductor 1*a* is applied to the primary transfer roller 11*a*. In the present embodiment, the primary transfer voltage has a plus (positive) polarity. Thus, a transfer electric field is generated between the photoconductor 1*a* and the intermediate transfer belt 3, and the black toner image on the photoconductor 1*a* is electrostatically transferred onto the intermediate transfer belt 3 that rotates in synchronization with the photoconductor 1*a*. After the black toner image is transferred onto the intermediate transfer belt 3, a cleaner 12*a* for black toner removes transfer residual toner remaining on the surface of the photoconductor 1*a*.

Similarly, magenta toner images, cyan toner images, and yellow toner images are formed on the photoconductors 1*b*, 1*c*, and 1*d*, respectively. The yellow toner images, the cyan toner images, the magenta toner images, and the black toner images are sequentially transferred and superimposed one on another onto the intermediate transfer belt 3.

The printer 100 has two drive modes: a full-color mode using at least two of four toners of different colors and a monochrome mode using only black toner. In the full-color mode, the intermediate transfer belt 3 contacts the four photoconductors 1*a*, 1*b*, 1*c*, and 1*d*, and the toner images of four colors are transferred onto the intermediate transfer belt 3 one on another. By contrast, in the monochrome mode, the intermediate transfer belt 3 contacts only the photoconductor 1*a* for black, and only the black toner images are transferred onto the intermediate transfer belt 3. In the monochrome mode, primary transfer rollers 11*b*, 11*c*, and 11*d* are moved away from the photoconductors 1*b*, 1*c*, and 1*d* by a belt contact-separation mechanism 80 to be described later, and the intermediate transfer belt 3 is separated from the photoconductors 1*b*, 1*c*, and 1*d* for the colors of magenta, cyan, and yellow.

As illustrated in FIG. 1, a sheet feeder 14 is disposed in a bottom section of the apparatus body housing 101 of the printer 100. The sheet feeder 14 includes a sheet feeding roller 15 to pick up and send a recording sheet P as a recording medium in a direction indicated by arrow B in FIG. 1. The fed recording sheet P strikes a registration roller pair 16 and temporarily stops.

A secondary transfer roller 17 contacts a portion of the intermediate transfer belt 3 wound around the secondary transfer backup roller 4, thereby forming a secondary transfer nip. The recording sheet P that has struck the registration roller pair 16 is fed towards the secondary transfer nip with predetermined timing. At that time, the secondary transfer roller 17 is supplied with a predetermined secondary transfer voltage to secondarily transfer the toner images superimposed on the intermediate transfer belt 3 onto the recording sheet P.

The recording sheet P on which the toner images are secondarily transferred is further conveyed upward in the apparatus body housing 101 and passes through a fixing device 18. At that time, the fixing device 18 fixes the toner images on the recording sheet P with heat and pressure. After the recording sheet P passes through the fixing device 18, the recording sheet P is ejected outside the printer 100 through a sheet ejection roller pair 19 of a discharge section.

A belt cleaner 20 removes transfer residual toner adhering to the surface of the intermediate transfer belt 3 after the toner images are secondarily transferred to the recording sheet P. In the present embodiment, the belt cleaner 20 includes a cleaning blade 21 made of suitable material, such as urethane, held against the belt moving direction of the intermediate transfer belt 3 to mechanically remove transfer residual toner. The belt cleaner 20 is not limited to the structure described above but can be selected from various cleaning types. For example, a belt cleaner to electrostatically clean the intermediate transfer belt 3 can be used.

The transfer residual toner removed from the intermediate transfer belt 3 by the cleaning blade 21 is sent to the rear side in the longitudinal direction by a waste toner coil in a cleaning case and passes through a waste toner path provided in the apparatus body housing 101 of the printer 100, and conveyed to a waste toner container. Side seals are disposed on both ends of the cleaning blade 21 so as not to allow the removed transfer residual toner to leak around, and are affixed to the cleaning case. The side seal has a two-layer structure including a low sliding member and a foam member. In the present embodiment, the material of the low sliding member on the side in contact with the intermediate transfer belt 3 is GF0471 manufactured by AMBIC Co., Ltd., and the material of the foam member is SM55#60.

Belt devices included in comparative image forming apparatuses are described below.

The comparative image forming apparatuses include various endless belts, such as an image bearer, an intermediate transferor, a recording sheet conveyor, image fixing member, or the like. This kind of endless belt is looped and stretched taut around at least two support rotators to travel in a constant direction. The endless belt is drawn to one side in a direction perpendicular to the belt moving direction (i.e., belt deviation or belt walk occurs) due to physical materials of the endless belt, tolerances of relevant components, or deterioration of relevant components. The belt deviation causes deviation or misalignment of a transferred image on the recording medium or damage to the belt by coming off the support rotator. Therefore, it is necessary to minimize or correct the belt deviation.

There is a method for minimizing or correcting the belt deviation as follows. A detector detects movement of the belt toward one side, and a roller displacement member displaces the support rotator around which the belt is stretched taut based on the detected results. Thus, the belt deviation can be corrected.

For example, in a belt walk correction unit, an end portion of one of the support rotators (i.e., belt walk correction roller) is movable to correct belt walk in a direction perpendicular to a direction in which the belt is pressed. In this configuration, the belt walk correction unit includes a rotator disposed on at least one end portion of the belt walk correction roller. The rotator is movable along an axial direction of the belt walk correction roller and includes a contact face in contact with an end portion of the belt and an inclined face whose outer diameter changes along the axial direction of the belt walk correction roller. The belt walk correction unit further includes an immobile guide member disposed so as to abut against an outer surface of the rotator. In the belt walk correction unit having such a configuration, the end portion of the belt that is drawn to one side is contact with the rotator, the rotator moves due to movement of the belt, and the belt walk correction roller is inclined, thereby correcting the belt walk.

Next, descriptions are given below of an example of the configuration of the tension roller 5 and the intermediate transfer belt 3 according to the present disclosure.

Tension roller
Outer diameter: 26.18 mm
Material: aluminum
Intermediate transfer belt
Material: polyamideimide
Young's modulus: 3400 MPa
Folding endurance (number of times) measured in Massachusetts Institute of Technology (MIT) folding endurance test: 500 times or more
Thickness: 80 μm
Linear velocity: 256 mm/s
Belt tension at the time of image formation: 1.3 N/cm The measuring method of the MIT folding endurance test conforms to Japanese Industrial Standard (JIS)-P8115. More specifically, a sample having a width of 15 mm is measured under conditions of a testing load of 1 kgf, a flexion angle of 135 degrees, and a flexion speed of 175 times per minute.

Next, descriptions are given below of the belt alignment unit 50 to minimize the belt deviation employed in the intermediate transfer device 60 including the intermediate transfer belt 3.

Figure 3:
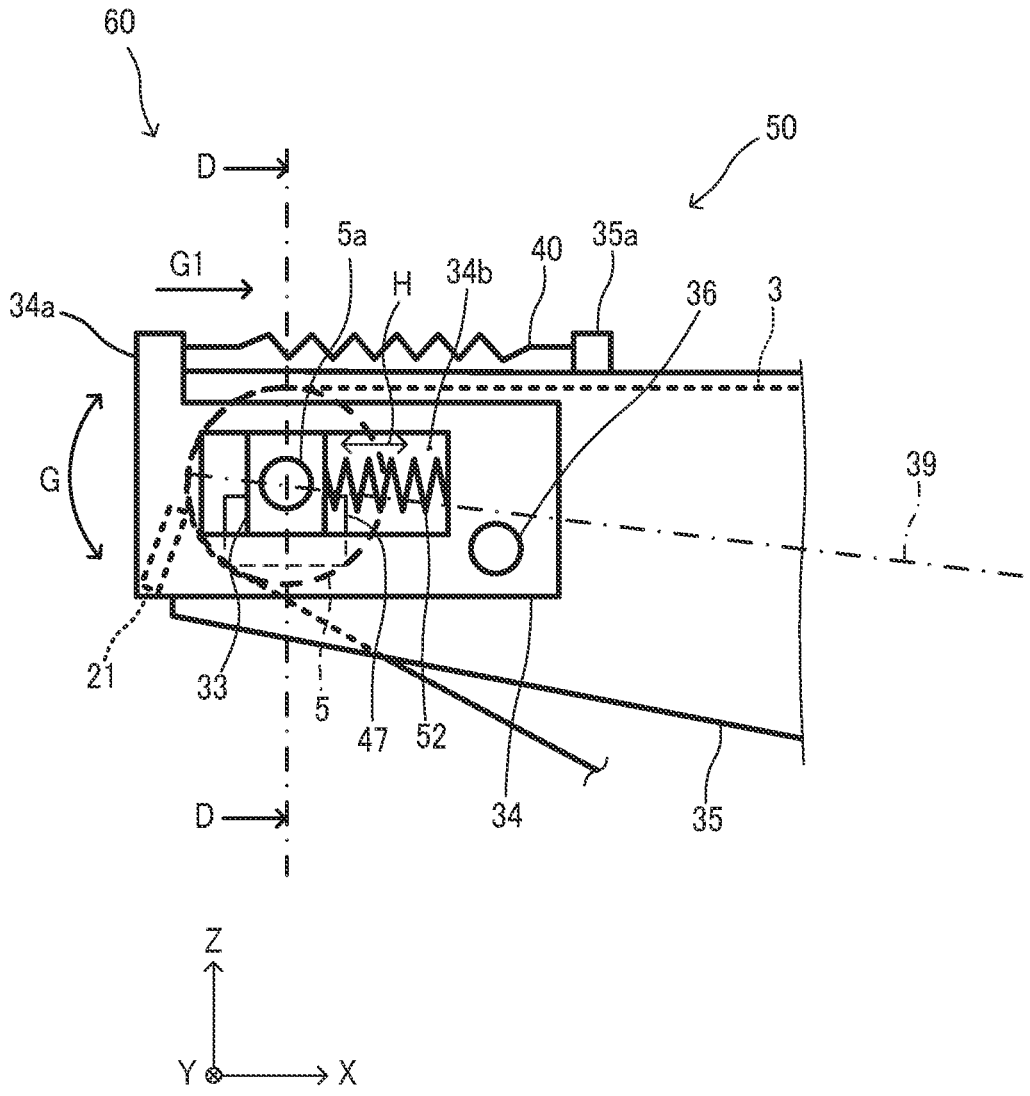
FIG. 3 is a schematic view of a belt alignment unit as viewed from the front side immediately after assembly.
Figure 4:
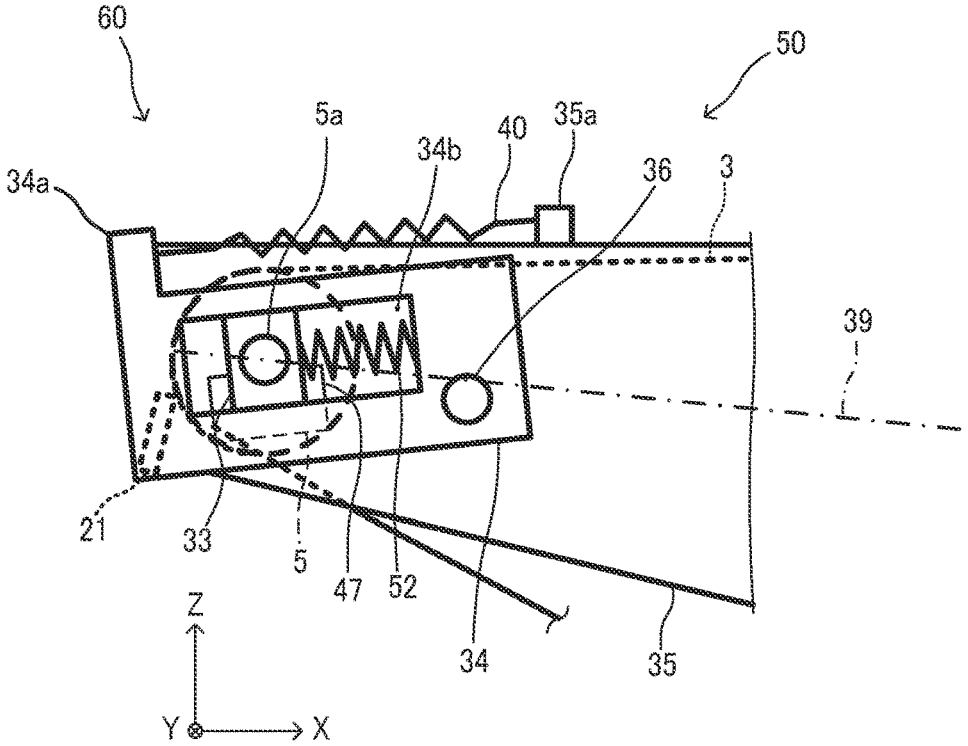
FIG. 4 is a schematic view of the belt alignment unit as viewed from the front side after belt deviation correction.

FIGS. 3 and 4 are schematic views of the belt alignment unit 50 of the intermediate transfer device 60. The belt alignment unit 50 according to the present embodiment includes a shaft inclination mechanism to incline a rotation axis of the tension roller 5, which is one of the plurality of support rotators to support the intermediate transfer belt 3, to restrict the belt deviation within a predetermined range.

FIG. 3 is a schematic view illustrating the belt alignment unit 50 of the intermediate transfer device 60 immediately after assembly, as viewed from the front side of the tension roller 5 in an axial direction in FIG. 1. FIG. 4 is a schematic view illustrating the belt alignment unit 50 of the intermediate transfer device 60 after the belt deviation correction, as viewed from the front side of the tension roller 5 in the axial direction in FIG. 1.

Figure 2:
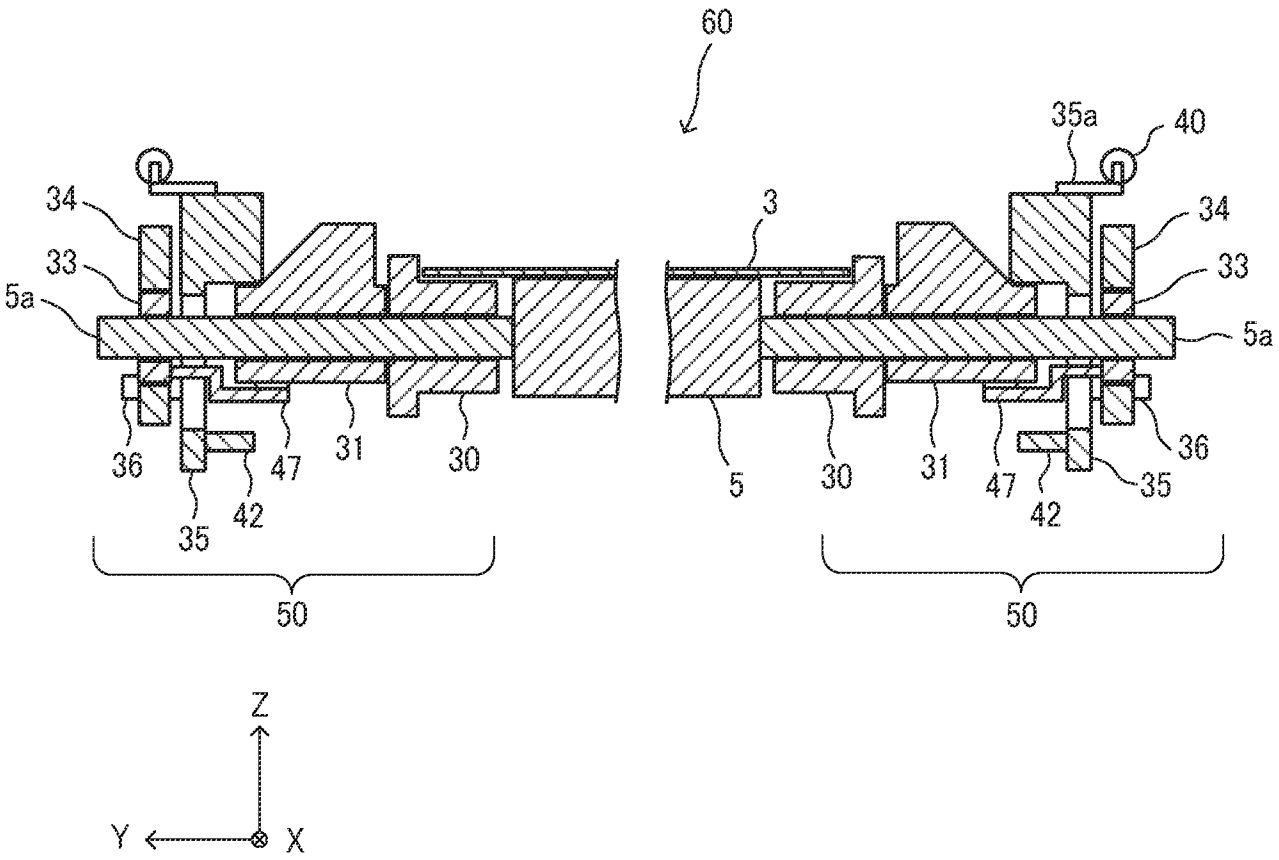
FIG. 2 is a schematic cross-sectional view of an intermediate transfer device according to an embodiment of the present disclosure.
Figure 5:
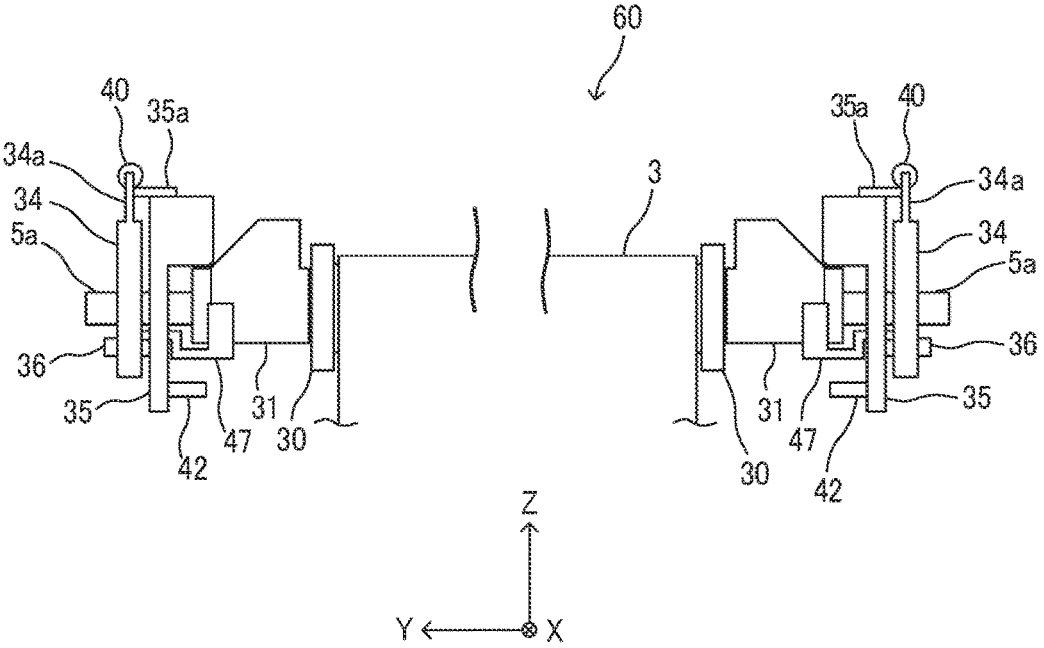
FIG. 5 is a schematic side view of the intermediate transfer device according to an embodiment of the present disclosure.

FIG. 5 is a schematic side view of the intermediate transfer device 60 as viewed from the left side in FIG. 3. FIG. 2 is a schematic cross-sectional view of the intermediate transfer device 60 along line D-D illustrated in FIG. 3.

Figure 6:
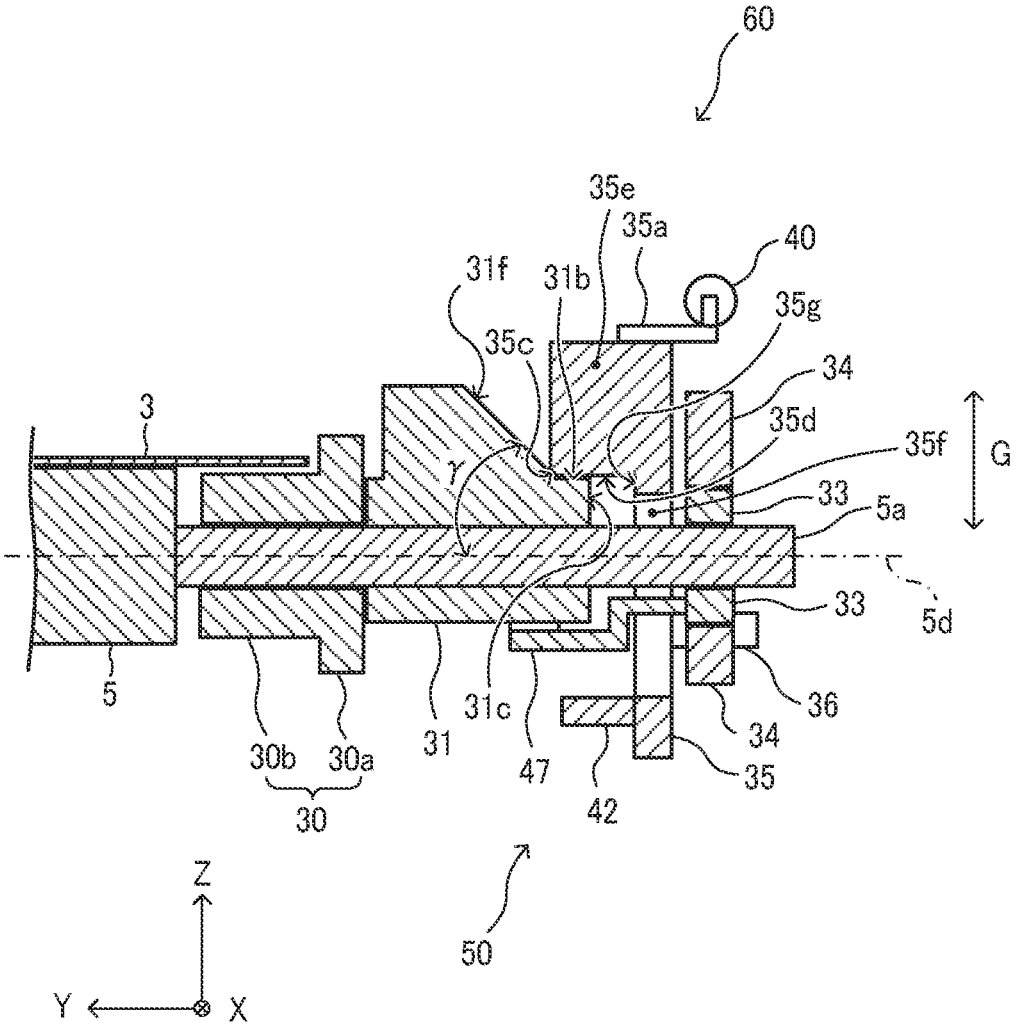
FIG. 6 is an enlarged cross-sectional view of the belt alignment unit immediately after assembly.
Figure 7:
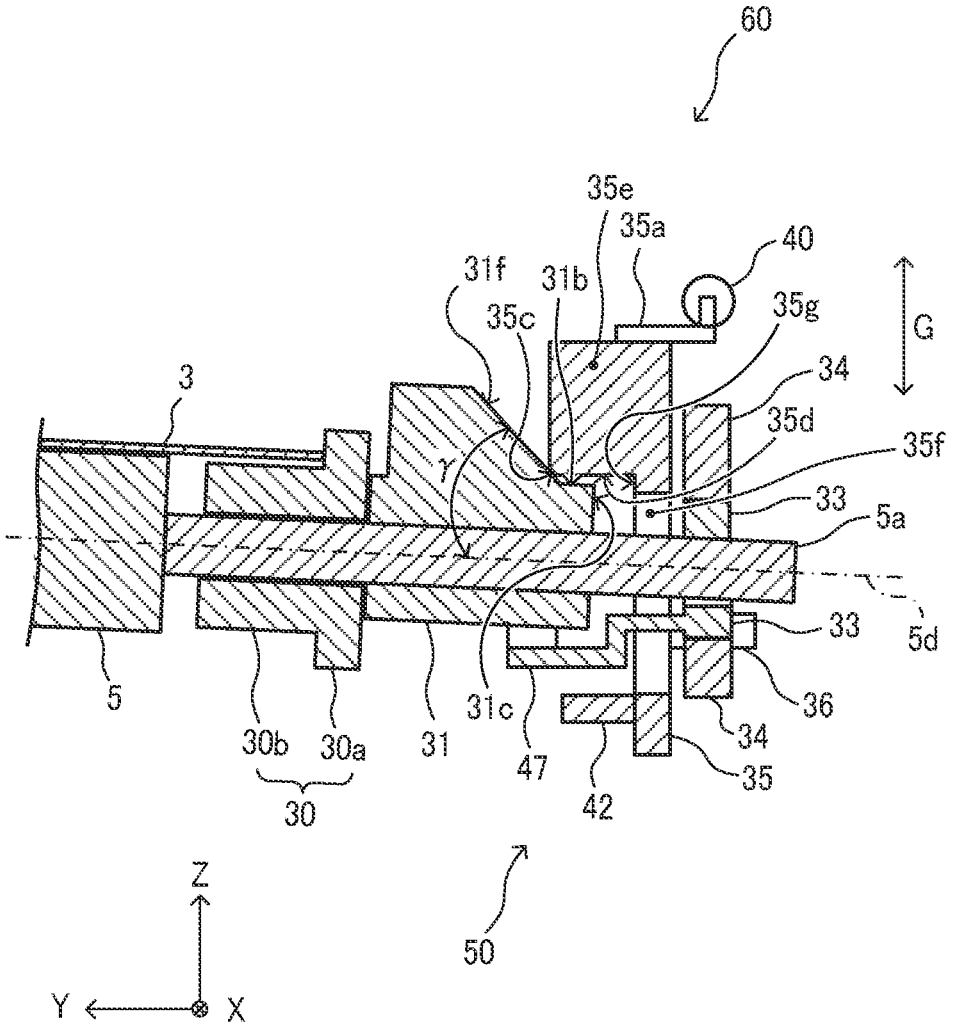
FIG. 7 is an enlarged cross-sectional view of the belt alignment unit after belt deviation correction.

FIG. 6 is a schematic enlarged cross-sectional view on the front side of the belt alignment unit 50 (right side in FIG. 2). FIG. 7 is a schematic enlarged cross-sectional view on the front side of the belt alignment unit 50 (right side in FIG. 2) when a tension roller shaft 5*a* of the tension roller 5 moves downward and the tension roller 5 is inclined.

As illustrated in FIG. 2, the tension roller shaft 5*a* is coaxially disposed outboard of an end portion of the tension roller 5. The tension roller shaft 5*a* has a cylindrical shape smaller in diameter than the tension roller 5 and is joined with the tension roller 5. The belt alignment unit 50 includes a belt deviation follower 30, a shaft inclining member 31, a frame 35, and a roller shaft support 34, which are disposed on the tension roller shaft 5*a* and arranged in that order from a center side in the axial direction of the tension roller 5. The tension roller shaft 5*a* penetrates these components: the belt deviation follower 30, the shaft inclining member 31, the frame 35, and the roller shaft support 34. Both end portions of the tension roller shaft 5*a* are supported by the roller shaft supports 34 via the tension roller bearings 33.

In the belt alignment unit 50, the belt deviation follower 30 and the shaft inclining member 31 are freely movable in the axial direction relative to the tension roller shaft 5*a*. In the direction perpendicular to the axis of the tension roller shaft 5*a*, the belt deviation follower 30 and the shaft inclining member 31 move with the tension roller shaft 5*a*.

The intermediate transfer device 60 includes a frame 35 made of sheet metal or the like. In a state in which the intermediate transfer device 60 is mounted in the apparatus body of the printer 100, the frame 35 is secured to the apparatus body housing 101 and is stationary even when the tension roller shaft 5*a*, the belt deviation follower 30, and the shaft inclining member 31 move. The frame 35 includes a spring secured portion 35*a* and a support rotation shaft 36 that protrude outward from an outer surface of the frame 35 in the axial direction. In addition, the frame 35 has a frame opening 35*f* that is penetrated by the tension roller shaft 5*a* and a rotation stopper 47 to be described later. The tension roller shaft 5*a* and the rotation stopper 47 receive a pressing force of a tension spring 52 and a force thereagainst (belt tension) and a tensile force of a support spring 40 and a force thereagainst (downward force due to its own weight and the belt deviation). Due to variations of these forces, the tension roller shaft 5*a* is displaced in a direction perpendicular to the rotation axis of the tension roller 5. The frame opening 35*f* is shaped so that the tension roller shaft 5*a* and the rotation stopper 47 do not interfere with the frame 35 regardless of the displacement thereof.

The roller shaft support 34 is pivotable about the support rotation shaft 36 in the direction indicated by arrow Gin FIG. 3 relative to the frame 35. One end of the support spring 40 is secured to the spring secured portion 35*a* of the frame 35. The support spring 40 pulls the roller shaft support 34 in a direction indicated by arrow G1 in FIG. 3. The other end of the support spring 40 is secured to a spring secured portion 34*a* of the roller shaft support 34.

The support springs 40 pull the roller shaft supports 34 disposed at both ends of the tension roller shaft 5*a*, respectively, so that the roller shaft support 34 pivots clockwise in FIG. 3 around the support rotation shaft 36.

As the roller shaft support 34 pivots around the support rotation shaft 36, the end of the tension roller shaft 5*a* supported by the roller shaft support 34 via the tension roller bearing 33 is displaced in the vertical direction.

The roller shaft supports 34 have bearing slide slots 34*b* and support the tension roller bearings 33. The tension roller bearing 33 is slidable in a radial direction of rotation of the roller shaft support 34 indicated by arrow H in FIG. 3 from the rotation center of the roller shaft support 34. The tension spring 52 presses the tension roller bearing 33 outward in the radial direction of rotation of the roller shaft support 34 from the rotation center of the roller shaft support 34 (leftward in FIG. 3). With this configuration, the tension roller 5 is always biased in a direction in which the tension roller 5 separates from the secondary transfer backup roller 4. Accordingly, a certain tension is applied to the intermediate transfer belt 3 looped around the tension roller 5 and the secondary transfer backup roller 4.

As illustrated in FIG. 6, the belt deviation follower 30 and the shaft inclining member 31 are disposed on the tension roller shaft 5*a* between the tension roller 5 and the tension roller bearing 33. The belt deviation follower 30 and the shaft inclining member 31 constitute a rotator inclination unit. The belt deviation follower 30 is disposed outboard of the tension roller 5 in the axial direction of the tension roller 5, and the shaft inclining member 31 is disposed outboard of the belt deviation follower 30 in the axial direction of the tension roller 5. The belt deviation follower 30 includes a flange 30*a* and a cylindrical portion 30*b*. The cylindrical portion has a smaller outer diameter than the tension roller 5. The flange 30*a* has a larger outer diameter than the tension roller 5. As the intermediate transfer belt 3 is drawn to one side in the width direction (i.e., belt deviation occurs), an end face of the intermediate transfer belt 3 contacts the inside surface of the flange 30*a* in the axial direction.

Next, descriptions are given of the belt alignment unit 50 of the intermediate transfer device 60 according to the present embodiment.

As the secondary transfer backup roller 4 as a driving roller starts rotating, the tension roller 5 as a driven roller starts rotating. Around the secondary transfer backup roller 4 and the tension roller 5, the intermediate transfer belt 3 is looped. At that time, in the case in which the end face of the intermediate transfer belt 3 is in contact with the belt deviation follower 30, the belt deviation follower 30 also starts rotating.

In this state, if the intermediate transfer belt 3 is drawn to the right in FIG. 6 in the belt width direction (the axial direction of the tension roller 5) due to effects of parallelism between the components, the right end (in FIG. 5) of the intermediate transfer belt 3 in the belt width direction contacts the flange 30*a* of the belt deviation follower 30. In this specification, the term "belt deviation" means that the belt is drawn to one side in the belt width direction. Receiving the force of contact, the belt deviation follower 30 moves outward along the tension roller shaft 5*a* (rightward in FIG. 6) in the axial direction thereof As the belt deviation follower 30 moves toward the end of the tension roller shaft 5*a*, the shaft inclining member 31 is pushed outward in the axial direction by the belt deviation follower 30. The shaft inclining member 31 is closer to the end of the tension roller shaft 5*a* than the belt deviation follower 30. Then, the shaft inclining member 31 also moves outward along the tension roller shaft 5*a* in the axial direction.

The upper side of the shaft inclining member 31 in FIG. 6 includes an inclined face 31*f* inclined relative to the tension roller shaft 5*a*. A contact portion 35*c* of the frame 35 contacts the inclined face 31*f* of the shaft inclining member 31 from outside the tension roller shaft 5*a* in the axial direction (right side in FIG. 6). The end portion of the tension roller shaft 5*a* closer to the end (on right in FIG. 6) in the axial direction than the shaft inclining member 31 is supported by the roller shaft support 34 via the tension roller bearing 33, as described above. Since the support spring 40 biases the roller shaft support 34 to pivot clockwise in FIG. 3 around the support rotation shaft 36, the end of the tension roller shaft 5*a* is biased upward in FIG. 6.

The shaft inclining member 31 includes a stopped face 31*b* that is continuous with a lower end of the inclined face 31*f* and extending in the axial direction of the tension roller shaft 5*a*. In a state in which the edge of the intermediate transfer belt 3 is not in contact with the flange 30*a*, the stopped face 31*b* of the shaft inclining member 31 is urged upward by the support spring 40 and contacts the stopper face 35*d* of the frame 35. Accordingly, at the position at which the stopped face 31*b* of the shaft inclining member 31 contacts the stopper face 35*d* of the frame 35, the position at which the inclined face 31*f* of the shaft inclining member 31 abuts against the contact portion 35*c* of the frame 35 is determined. That is, in the state, as illustrated in FIG. 6, in which the contact portion 35*c* of the frame 35 abuts against the lower end of the inclined face 31*f* of the shaft inclining member 31, the relative positions thereof are maintained.

From this state, when the intermediate transfer belt 3 is urged to move to the right in FIGS. 1 and 6 in the belt width direction, as described above, the edge of the intermediate transfer belt 3 contacts the flange 30*a* of the belt deviation follower 30. When the intermediate transfer belt 3 moves further to the right in FIG. 3 in the belt width direction, the belt deviation follower 30 and the shaft inclining member 31 move along the tension roller shaft 5*a* to the end side (right side in FIG. 6) in the axial direction.

At that time, the contact portion 35*c* of the frame 35 relatively moves along the inclined face 31*f* of the shaft inclining member 31. The contact position at which the inclined face 31*f* of the shaft inclining member 31 contacts the contact portion 35*c* of the frame 35 moves up towards the upper portion of the inclined face 31*f* of the shaft inclining member 31. Since the contact portion 35*c* is a part of the frame 35 and is secured to the apparatus body housing 101 of the printer 100, the contact portion 35*c* is not displaced and the shaft inclining member 31 having the inclined face 31*f* is displaced downward due to the reaction force received from the contact portion 35*c*.

As a result, the end portion of the tension roller shaft 5*a* on the side to which the intermediate transfer belt 3 is drawn (i.e., "belt drawing side") is pushed down against the upward biasing force exerted by the support spring 40.

At that time, on the side (left side in FIG. 2) opposite the belt drawing side, the end face of the intermediate transfer belt 3 is not in contact with the flange 30*a* of the belt deviation follower 30 on the left side in FIG. 2. Therefore, similar to FIG. 6, on the end portion of the tension roller shaft 5*a* on the side opposite the belt drawing side, the contact portion 35*c* of the frame 35 is kept in contact with the lower end of the inclined face 31*f* of the shaft inclining member 31.

Accordingly, the end portion of the tension roller shaft 5*a* on the belt drawing side (right side in FIG. 2) is pressed lower relative to the other end portion, thereby inclining the tension roller shaft 5*a* as illustrated in FIG. 7.

As the tension roller shaft 5*a* thus inclines, the speed at which the intermediate transfer belt 3 deviates in the belt width direction gradually slows down, and, eventually, the intermediate transfer belt 3 moves in the direction opposite to the belt drawing direction. As a result, the position of the intermediate transfer belt 3 in the belt width direction returns gradually, thereby running the intermediate transfer belt 3 on track and enabling the intermediate transfer belt 3 to travel reliably. The same is true for the case where the intermediate transfer belt 3 is drawn to the opposite side to the case described above.

Descriptions are provided of a principle of correction of deviation of the intermediate transfer belt 3 by inclining the tension roller shaft 5*a*.

Figure 8A:
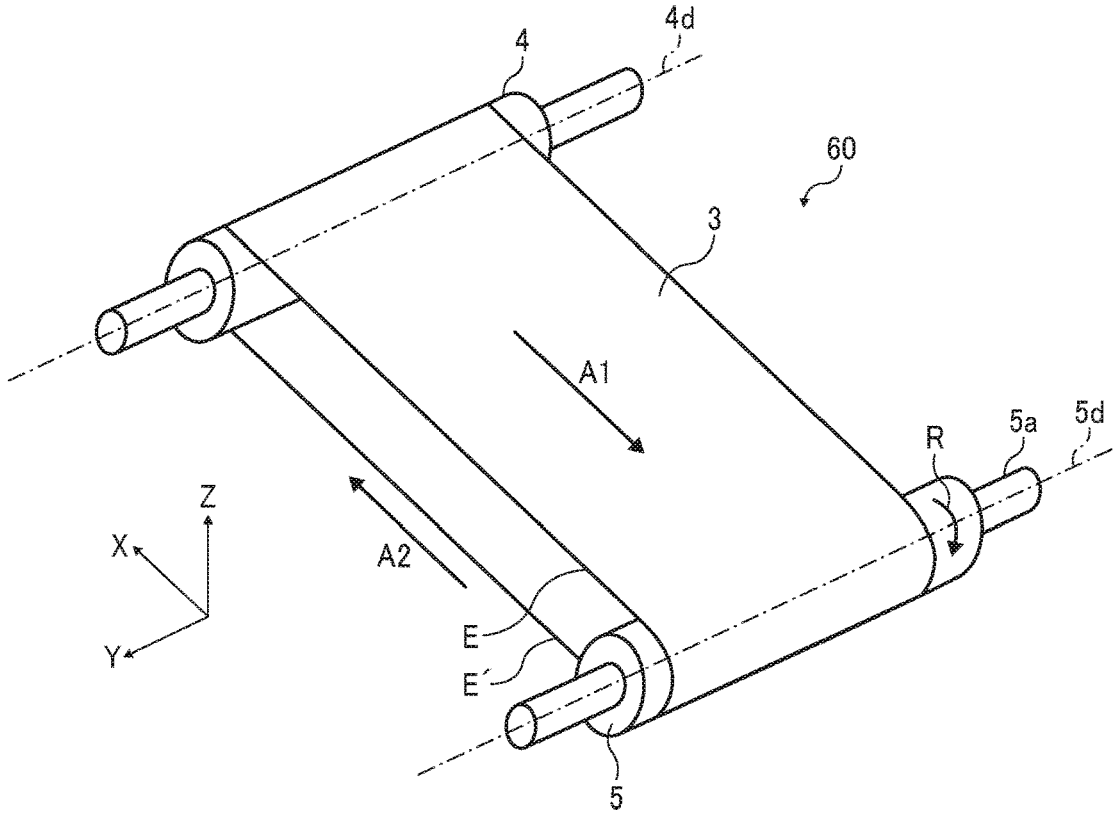
FIG. 8A is a schematic perspective view of the intermediate transfer device in which rotation axes of two rollers are parallel.
Figure 8B:
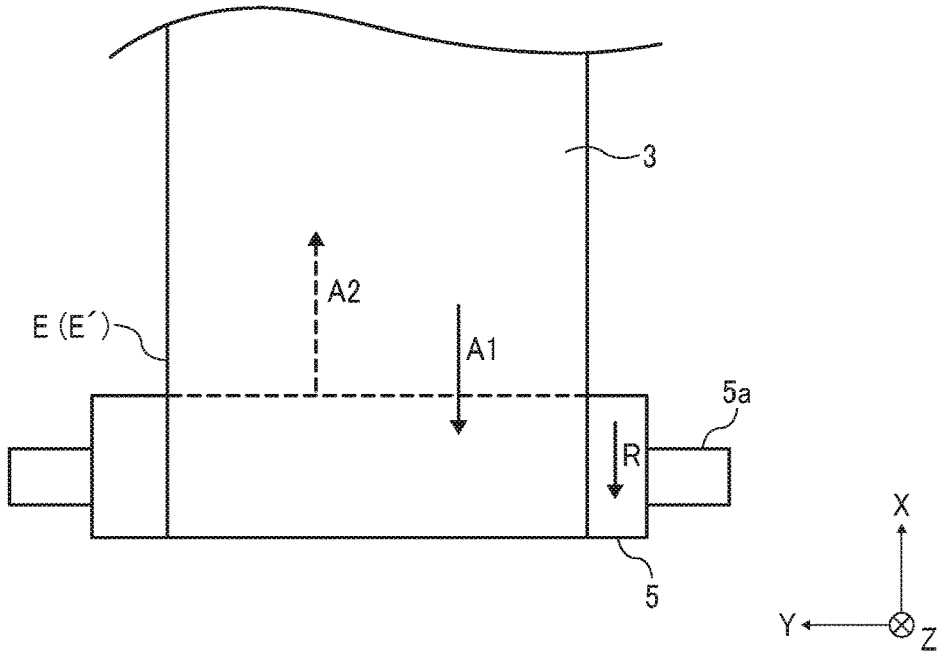
FIG. 8B is a schematic top view of the intermediate transfer device in which the rotation axes of the two rollers are parallel.

FIGS. 8A and 8B are schematic views of the intermediate transfer device 60 in a condition in which the rotation axis 5*d* of the tension roller 5 and the rotation axis 4*d* of the secondary transfer backup roller 4 are parallel. FIG. 8A is a schematic perspective view illustrating only the tension roller 5 and the secondary transfer backup roller 4 of the plurality of support rotators and the intermediate transfer belt 3. FIG. 8B is a schematic partial top view of the intermediate transfer device 60 around the tension roller 5.

Figure 9A:
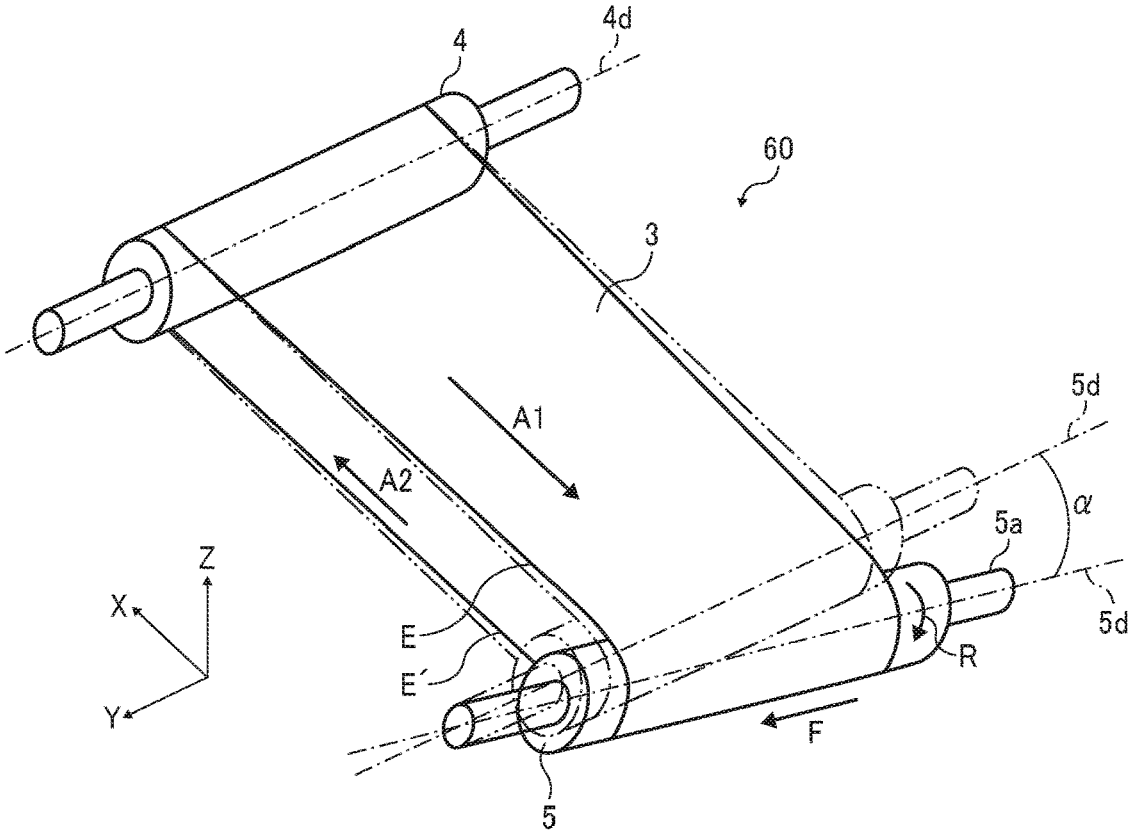
FIG. 9A is a schematic perspective view of the intermediate transfer device in which the rotation axes of the two rollers are inclined each other.
Figure 9B:
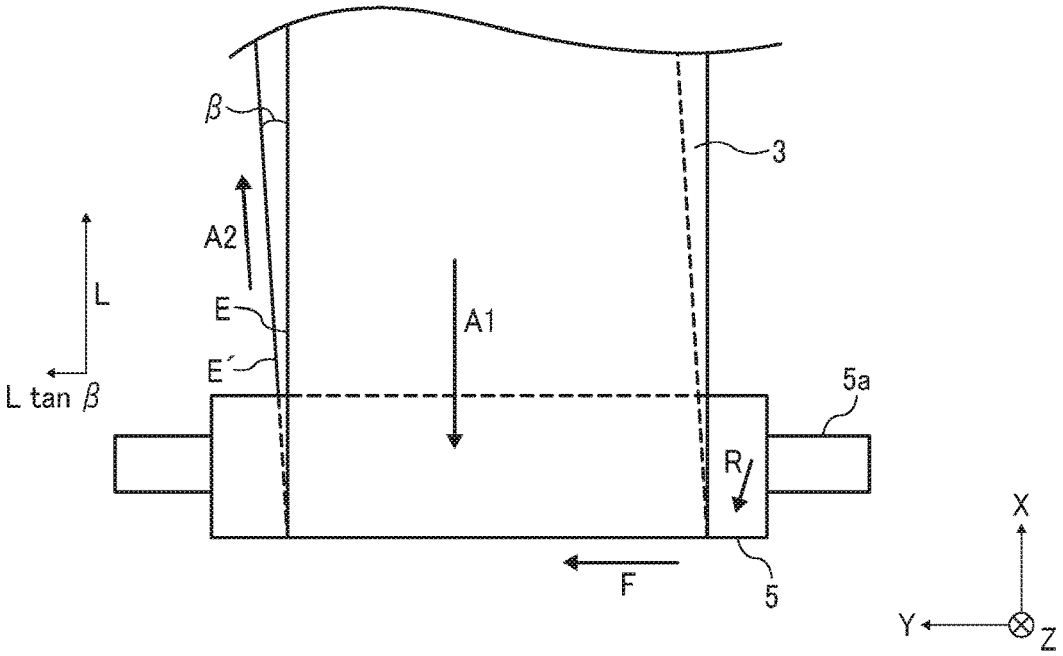
FIG. 9B is a schematic top view of the intermediate transfer device in which the rotation axes of the two rollers are inclined each other.

FIGS. 9A and 9B are schematic views of the intermediate transfer device 60 in a state in which the rotation axis 5*d* of the tension roller 5 is inclined relative to the rotation axis 4*d* of the secondary transfer backup roller 4 by angle α. Right end of the tension roller shaft 5*a* moves downward from the state in FIGS. 8A and 8B. FIG. 9A is a schematic perspective view illustrating only the tension roller 5 and the secondary transfer backup roller 4 of the plurality of support rotators and the intermediate transfer belt 3. FIG. 9B is a schematic partial top view of the intermediate transfer device 60 around the tension roller 5. In FIG. 9A, a chain double-dashed line is a phantom line that represents the position of the tension roller 5 and the intermediate transfer belt 3 before inclining the rotation axis 5*d* of the tension roller 5.

As illustrated in FIG. 2, the width of the intermediate transfer belt 3 according to the present embodiment is wider than a length of the tension roller 5 in the axial direction. In FIGS. 8A, 8B, 9A, and 9B, however, the tension roller 5 is illustrated long in the axial direction for convenience of explanation.

Arrow A1 in FIGS. 8A, 8B, 9A, and 9B indicates the belt moving direction of the intermediate transfer belt 3 before reaching the position in contact with the tension roller 5 by the surface movement. Arrow A2 in FIGS. 8A, 8B, 9A, and 9B represents the belt moving direction of the intermediate transfer belt 3 after passing through a portion of the tension roller 5 around which the intermediate transfer belt 3 is looped and leaving the tension roller 5. Arrow R in FIGS. 8A, 8B, 9A, and 9B represents a direction of surface movement of the tension roller 5 in the portion where the intermediate transfer belt 3 is looped around. The surface of tension roller 5 in the portion around which the intermediate transfer belt 3 is looped moves from top to bottom.

The secondary transfer backup roller 4 is one of the support rotators that stretches taut the intermediate transfer belt 3 at the upstream from the tension roller 5.

As the intermediate transfer belt 3 rotates, the tension roller 5 is rotated by friction between an inner surface of the intermediate transfer belt 3 and an outer surface of the tension roller 5. At that time, a force along the direction of surface movement of the tension roller 5 act on the portion of the intermediate transfer belt 3 looped around the tension roller 5.

An arbitrary point on the intermediate transfer belt 3 upstream in the belt moving direction from the contact portion winding around the tension roller 5 is observed. Then, an arbitrary point on the end face of the intermediate transfer belt 3 immediately before advancing to the tension roller 5 is referred to as a point E, and a point corresponding to the point E immediately after leaving the tension roller 5 is referred to as a point E'.

In a state in which two rotation axes of the secondary transfer backup roller 4 and the tension roller 5 are parallel as illustrated in FIGS. 8A and 8B, the belt moving direction (arrow A1) and the direction (arrow R) of surface movement of the tension roller 5 are parallel as viewed from the top as illustrated in FIG. 8B. Thus, a force along the tension roller shaft 5*a* does not act on the portion of the intermediate transfer belt 3 looped around the tension roller 5. The intermediate transfer belt 3 moves parallel to Arrow A1 as viewed from the top. At that time, as the tension roller 5 rotates, the point E does not move in the axial direction of the tension roller 5 while rotating on the circumferential face of the tension roller 5.

Then, the belt moving direction (arrow A2) after leaving the tension roller 5 is parallel and opposite to the belt moving direction (arrow A1) before advancing to the tension roller 5 as viewed from the top. Accordingly, as illustrated in FIG. 8B, as the intermediate transfer belt 3 near the tension roller 5 is observed from the top, the intermediate transfer belt 3 after leaving the tension roller 5 is hidden under the intermediate transfer belt 3 before advancing the tension roller 5. The deviation of the position in the axial direction of the tension roller 5 between the point E and the point E' does not occur. In this case, the intermediate transfer belt 3 is not drawn to one side in the axial direction.

As described above, the rotation axis of the tension roller 5 is inclined at an inclination angle $\alpha$ relative to the rotation axis of the secondary transfer backup roller 4 in FIGS. 9A and 9B. In a state in FIGS. 9A and 9B, the belt moving direction (arrow A1) and the direction (arrow R) of surface movement of the tension roller 5 are inclined from each other as viewed from the top as illustrated in FIG. 9B. Thus, a force along the tension roller shaft 5*a* indicated by arrow F in FIGS. 9A and 9B acts on the intermediate transfer belt 3 as the intermediate transfer belt 3 is obliquely wound around the tension roller 5. Here, a slope of the belt moving direction (arrow A2) after leaving the tension roller 5 against the belt moving direction (arrow A1) before advancing to the tension roller 5 is an angle $\beta$. In this case, the point E moves to the left by a distance L tan $\beta$ in the axial direction of the tension roller 5 in FIG. 9B while moving on the surface of the tension roller 5 by a distance L.

When viewed from the top, the larger the slope of the direction (arrow R) of surface movement of the tension roller 5 relative to the belt moving direction (arrow A1) before advancing to the tension roller 5 is, the larger the angle $\beta$ is. Additionally, the larger the inclination angle $\alpha$ of the rotation axis 5*d* of the tension roller 5 relative to the rotation axis 4*d* of the secondary transfer backup roller 4 is, the larger the angle $\beta$ is. Accordingly, the larger the inclination angle $\alpha$ is, the larger the amount of the belt deviation of the intermediate transfer belt 3 (moving speed in the width direction of the belt) is.

That is, the amount of deviation to one side of the intermediate transfer belt 3 increases as the inclination angle $\alpha$ increases, and the amount of deviation decreases as the inclination angle $\alpha$ decreases. Therefore, for example, as illustrated in FIG. 7, when the intermediate transfer belt 3 is drawn to the right side in FIG. 7 (belt deviation), the shaft inclining member 31 moves to the right side in FIG. 7 along the axial direction of the tension roller 5. As a result, the right end portion of the tension roller shaft 5*a* is displaced downward in FIG. 7, and the tension roller shaft 5*a* is inclined so that the right side thereof is lowered. Accordingly, the belt drawing to return the intermediate transfer belt 3 to the left occurs.

Then, the belt deviation can be corrected and the intermediate transfer belt 3 is adjusted at the position where the initial deviation (i.e., to the right in FIG. 3) of the intermediate transfer belt 3 is balanced with the opposite deviation caused by inclining the tension roller shaft 5*a* of the tension roller 5. Further, in the case where the intermediate transfer belt 3 traveling at the balanced position starts to deviate to either side, the inclination of the tension roller shaft 5*a* in accordance with the deviation of the intermediate transfer belt 3 brings the intermediate transfer belt 3 to the balanced position again.

As described above, according to the present embodiment, the belt alignment unit 50 of the intermediate transfer device 60 inclines the tension roller shaft 5*a* by the inclination angle corresponding to the amount of deviation of the intermediate transfer belt 3 in the belt width direction, thereby promptly correcting the deviation of the intermediate transfer belt 3. Further, the force of the intermediate transfer belt 3 moving in the belt width direction is used to incline the tension roller shaft 5*a*. Accordingly, belt deviation can be corrected with a simple structure, and use of an additional drive source such as a motor is obviated.

In a configuration that does not incline the axis of the support rotator such as the tension roller and does not control the belt deviation by the inclination of the shaft, a belt abutting member pushes back an end face of the belt to control the deviation of the belt. With such a configuration, stress is constantly applied to the end face of the belt. The end face of the belt is weakest point of the belt. Therefore, if the end face receives the stress, the end portion of the belt may be broken. By contrast, in the intermediate transfer device 60 according to the present embodiment, the tension roller 5 is inclined, and a force to move the intermediate transfer belt 3 in the direction opposite to the belt deviation acts on the intermediate transfer belt 3, thereby reducing the load on the end face of the intermediate transfer belt 3 and controlling the belt deviation.

Next, descriptions are provided of the shaft inclining member 31.

Figure 10A:
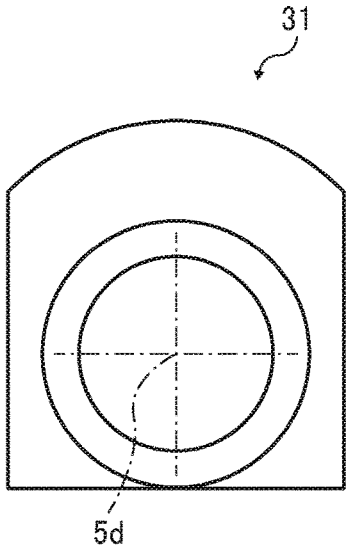
FIGS. 10A, 10B, 10C, and 10D are schematic views of a shaft inclining member.
Figure 10B:
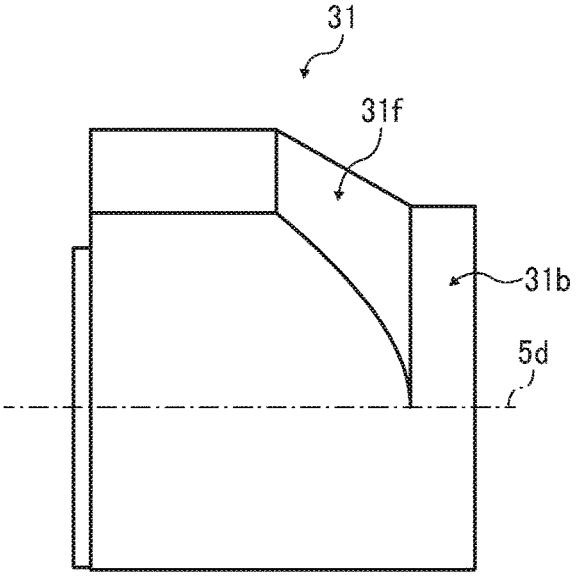
Figure 10C:
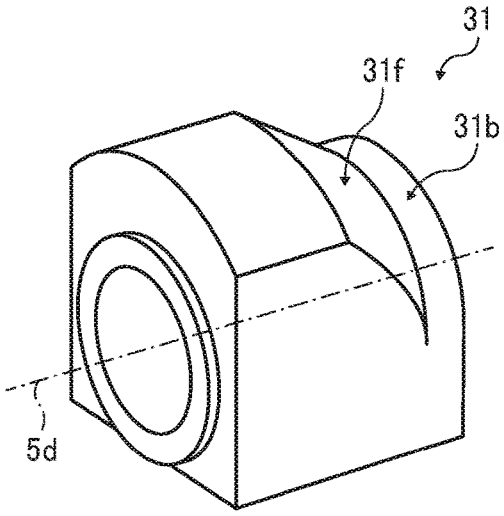
Figure 10D:
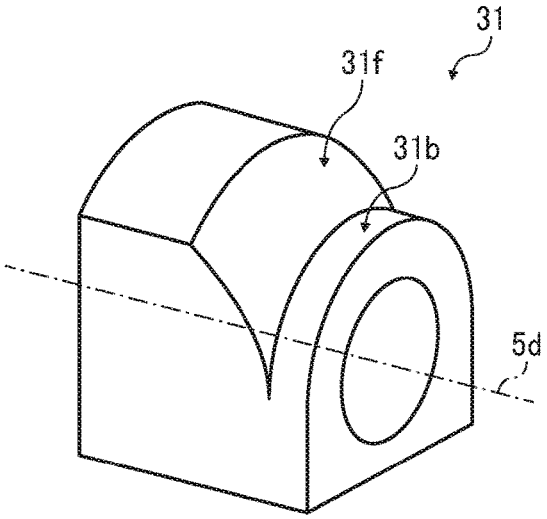

FIGS. 10A, 10B, 10C, and 10D are schematic views illustrating the shaft inclining member 31 according to the present embodiment. FIG. 10A is the schematic back view of the shaft inclining member 31 as viewed from the left in FIG. 6. FIG. 10B is the schematic side view of the shaft inclining member 31 as viewed from the front in FIG. 6. FIG. 10C is the schematic perspective view of the shaft inclining member 31 as viewed from the upper left front in FIG. 6. FIG. 10D is the schematic perspective view of the shaft inclining member 31 as viewed from the upper right front in FIG. 6.

The shaft inclining member 31 includes the inclined face 31*f* and the stopped face 31*b*. Inclined face 31*f* is curved such that, when the shaft inclining member 31 is attached to the tension roller 5, the inclined face 31*f* conforms to the surface of a conical shape coaxial with a virtual axis that coincides with the rotation axis 5*d* of the tension roller 5. The stopped face 31*b* is curved to conform to the surface of a cylindrical shape coaxial with the virtual axis.

There are two reasons for forming the inclined face 31*f* with a curved surface.

The first reason is that even when the shaft inclining member 31 rotates slightly around the tension roller shaft 5*a*, the angle of inclination of the rotation axis 5*d* of the tension roller 5 relative to the rotation axis 4*d* of the secondary transfer backup roller 4 does not change.

The second reason is that the curved surface of the inclined face 31*f* reduces contact between the inclined face 31*f* and the contact portion 35*c* of the frame 35 to a point contact, thereby reducing friction at the contact place. Accordingly, the belt deviation follower 30 and the shaft inclining member 31 are smoothly movable when a force along the tension roller shaft 5*a* acts on the belt deviation follower 30 and the shaft inclining member 31. With this configuration, the contact pressure at the end face of the intermediate transfer belt 3 contacting the flange 30*a* of the belt deviation follower 30 is reduced, thereby reducing deterioration of the edge portion of the intermediate transfer belt 3 and hence achieving extended belt life expectancy.

Although not limited thereto, in the present embodiment, the inclination angle γ in FIG. 6 of the inclined face 31*f* of the shaft inclining member 31 relative to the rotation axis 5*d* of the tension roller 5 is approximately 30 degrees. The shaft inclining member 31 may be made of polyacetal (POM), but is not limited to. The shaft inclining member 31 is inhibited from rotating around the tension roller shaft 5*a* by the rotation stopper 47 to be described in detail later with reference to FIG. 11.

The stopped face 31*b* of the shaft inclining member 31 can be also used for positioning. As illustrated in FIG. 6, the frame 35 includes a guide portion 35*e* projecting inward in the axial direction of the tension roller 5. The stopped face 31*b* being positioned at an initial position is in contact with the stopper face 35*d* as a bottom face of the guide portion 35*e*. With this configuration, the inclination of the tension roller 5 in an initial state after assembling can be constant.

If the shaft inclining member 31 does not include the stopped face 31*b* and the inclined face 31*f* extends to a right end of the shaft inclining member 31 in the axial direction in FIG. 6, the inclined face 31*f* contacts the guide portion 35*e* of the frame 35 in the initial state after assembly. In this case, since there is no standard position, the tension roller 5 may be obliquely assembled. In that case, the intermediate transfer belt 3 is drawn to one side from the initial state, and the tension roller 5 is inclined. Therefore, it may take long time to converge a belt walk of the intermediate transfer belt 3 (belt deviation). Depending on how the tension roller 5 is assembled, for example, due to a hang-up of the shaft inclining member 31, the belt deviation of the intermediate transfer belt 3 may be out of control. Therefore, an excessive load may act on the edge portion of the intermediate transfer belt 3 in the width direction. Alternatively, the intermediate transfer belt 3 may interfere with other components. In this case, the intermediate transfer belt 3 may be quickly cracked or damaged.

The stopped face 31*b* of the shaft inclining member 31 preferably contacts the stopper face 35*d* at both front and back sides of the printer 100 (right and left sides in FIG. 2 or both end in the axial direction). However, one side contact can minimize variation in an initial inclination of the tension roller 5.

A lower part of the guide portion 35*e* is the contact portion 35*c* having a linear corner that extends in the front-back direction in FIGS. 1 and 6, and the linear corner is rounded (curved), in particular, into R-shape. Since the contact portion 35*c* has the linear corner, even if a circumference of the intermediate transfer belt 3 changes and the tension roller 5 moves in the belt moving direction due to environmental variations, the shaft inclining member 31 can keep the point contact with the guide portion 35*e* at a same height.

The roller shaft support 34 is described in further detail below.

An imaginary line which is a bisector of the angle formed by a portion of the intermediate transfer belt 3 before advancing to the tension roller 5 and a portion of the intermediate transfer belt 3 after leaving the tension roller 5 illustrated in FIGS. 3 and 4 is referred to as a belt bisector 39. The support rotation shaft 36 of the roller shaft support 34 is disposed on the opposite side to a contact position between the inclined face 31*f* (see FIG. 6) and the guide portion 35*e* across the belt bisector 39.

In the intermediate transfer device 60 of the present embodiment, the contact position between the contact portion 35*c* of the guide portion 35*e* and the inclined face 31*f* is located above the belt bisector 39, and the support rotation shaft 36 is located below the belt bisector 39 as illustrated in FIG. 3.

A force toward the inside of the intermediate transfer belt 3 acts on each of the support rotators by tension of the intermediate transfer belt 3 (hereinafter, referred to as "belt tension") stretched around the plurality of support rotators. Thus, a force directed toward the right side in FIG. 3 acts on the tension roller 5 along the belt bisector 39.

Torque to revolve the tension roller 5 clockwise in FIG. 3 around the support rotation shaft 36 is provided by the belt tension.

This torque moves the shaft inclining member 31 upward and urges the inclined face 31*f* of the shaft inclining member 31 to move toward the contact portion 35*c* of the guide portion 35*e*. Thus, the shaft inclining member 31 and the guide portion 35*e* contact with each other and the tension roller 5 is inclined when the belt deviation occurs. If the support rotation shaft 36 can be disposed so that the torque due to the force acting by the belt tension maintains the contact state between the shaft inclining member 31 and the guide portion 35*e*, the support spring 40 is not required.

In the intermediate transfer device 60 according to the present embodiment, an outward movement of the shaft inclining member 31 in the axial direction is restricted to a certain range. More specifically, an outer end face 31*c* of the shaft inclining member 31 in the axial direction contacts a second stopper surface 35*g* of the frame 35, thereby preventing the shaft inclining member 31 from moving further outside in the axial direction. In the present embodiment, the second stopper surface 35*g* of the frame 35 restricts the outward movement of the shaft inclining member 31 in the axial direction. Alternatively, an inside face of the roller shaft support 34 or the tension roller bearing 33 in the axial direction can restrict the outward movement of the shaft inclining member 31.

Next, descriptions are provided of the rotation stopper 47 that prevents the shaft inclining member 31 from rotating around the tension roller shaft 5*a*.

Figure 11:
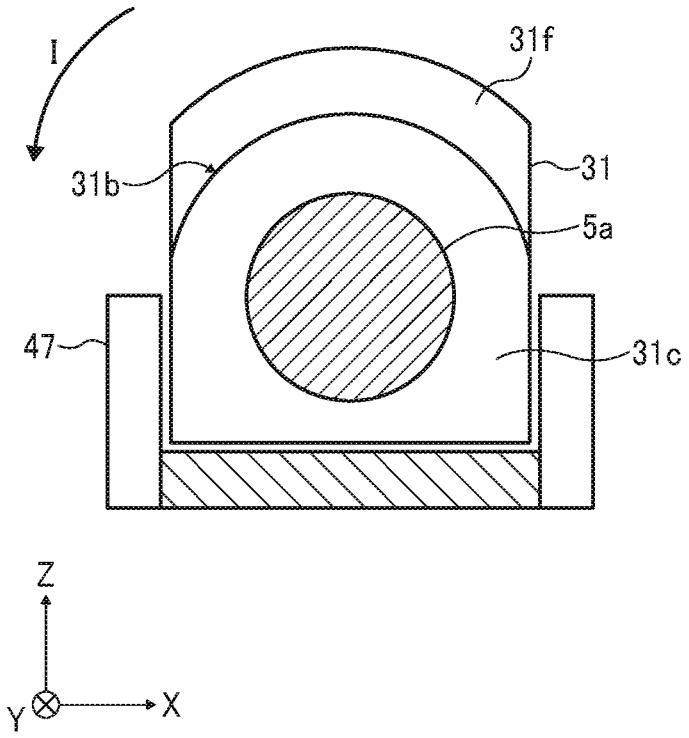
FIG. 11 is a schematic cross-sectional view of the shaft inclining member and a rotation stopper for the shaft inclining member as viewed from outer side in an axial direction in FIG. 6.

FIG. 11 is a schematic cross-sectional view of the shaft inclining member 31 and the rotation stopper 47 as viewed from the outer end face 31*c* in the axial direction in FIG. 6.

As illustrated in FIG. 11, the rotation stopper 47 covers side faces and a bottom face of the shaft inclining member 31. As illustrated in FIGS. 3, 4, 6, and 7, the rotation stopper 47 is joined with the tension roller bearing 33.

As the tension roller shaft 5*a* rotates together with tension roller 5, a force that rotates the shaft inclining member 31 in an x-z plain in a direction indicated by arrow I in FIG. 11 can act on the shaft inclining member 31. In this case, although the shaft inclining member 31 rotates in the direction indicated by arrow I in FIG. 11, a side face of the shaft inclining member 31 hits the rotation stopper 47. Therefore, the shaft inclining member 31 does not rotate any further.

The rotation stopper 47 does not include a portion that contacts both end faces of the shaft inclining member 31 in the axial direction (direction perpendicular to the surface of the paper on which FIG. 11 is drawn). Therefore, the shaft inclining member 31 is not prevented from moving along the axial direction of the tension roller shaft 5*a* by the rotation stopper 47. Accordingly, when the intermediate transfer belt 3 is drawn to one side, the shaft inclining member 31 can move outward in the axial direction without rotating around the tension roller shaft 5*a*.

Since the rotation stopper 47 is joined with the tension roller bearing 33, the rotation stopper 47 moves together with the tension roller shaft 5*a* in a direction of the sliding of the tension roller bearing 33 indicated by arrow H in FIG. 3.

The tension roller bearing 33 joined with the rotation stopper 47 is supported by the roller shaft support 34. Thus, when the roller shaft support 34 pivots in the direction indicated by arrow G in FIG. 3 and the tension roller shaft 5*a* moves in the vertical direction, the rotation stopper 47 moves together with the tension roller shaft 5*a* in the vertical direction.

As long as the rotation stopper 47 allows the shaft inclining member 31 to move in the axial direction and prevents the shaft inclining member 31 from rotating, the shape of the rotation stopper 47 is not limited to the shape illustrated in FIG. 11.

The rotation stopper 47 may be joined with other member that moves in conjunction with the tension roller shaft 5*a* and is not limited to the rotation stopper 47 joined with the tension roller bearing 33. For example, in the above-described embodiment, the belt deviation follower 30 rotates according to the movement of intermediate transfer belt 3. In a configuration in which the belt deviation follower 30 slides along the tension roller shaft 5*a* and not rotate, the rotation stopper 47 may be joined with the belt deviation follower 30.

Next, a belt tension relaxation mechanism (curling prevention mechanism) is described.

According to the present embodiment, the intermediate transfer device 60 includes the belt tension relaxation mechanism that moves the entry roller 7 toward the inside of the looped intermediate transfer belt 3 to relax the belt tension of the intermediate transfer belt 3.

In the printer 100, certain belt tension is applied to the intermediate transfer belt 3 at the time of image formation so that the intermediate transfer belt 3 appropriately rotates in accordance with the rotation of the driving roller.

If the intermediate transfer belt 3 is kept tensed for a long period of time, plastic deformation called curling can occur in a portion where a winding diameter of the support rotator is small. Especially, when the intermediate transfer belt 3 is left for a long time in a high temperature and high humidity environment, the degree of curling deteriorates. If an image forming operation is performed with the intermediate transfer belt 3 with the curling, an appropriate transfer nip is not formed at the time of transfer from the photoconductor 1 to the intermediate transfer belt 3, and an abnormal image due to transfer failure occurs. In recent years, reduction in the cost of intermediate transfer belts has been advanced due to demands for low cost, but many intermediate transfer belts made of low cost materials are likely to be curled.

The intermediate transfer belt 3 is often left for a long time in high temperature and high humidity environments in the period from manufacturing to delivery to customers.

Therefore, it is preferable to keep the belt tension relaxed or keep the winding portion of a support rotator small during such a period. Therefore, in the intermediate transfer device 60 of the present embodiment, the entry roller 7 having a small winding diameter (outer diameter of 13 mm) is moved to decrease the winding angle, and the belt tension is weakened to prevent the curling.

Specifically, the position of the entry roller 7 can be set at two positions, i.e., a tension applied position and a tension relaxed position, and a lever with the cam for moving the entry roller 7 is manually switched to change the position of the entry roller 7. When the entry roller 7 is moved to the tension relaxed position, the belt tension becomes relaxed and the winding angle of the intermediate transfer belt 3 with respect to the entry roller 7 decreases. With this configuration, the curling of the intermediate transfer belt 3 can be minimized.

In the intermediate transfer device 60 of the present embodiment, with such a configuration in which the tension roller 5 is inclined with respect to the other support rotators when the belt deviation occurs, when the belt tension is relaxed, the force acting on the tension roller 5 changes. As a result, the tension roller 5 and components moving together with the tension roller 5 may descend and interfere with the peripheral components.

Figure 12A:
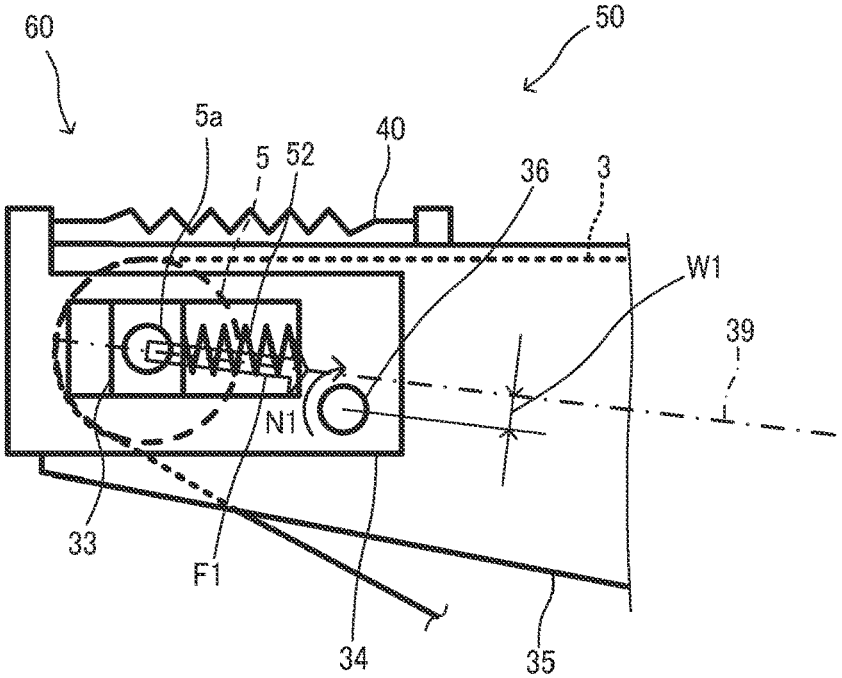
FIGS. 12A and 12B are schematic views illustrating that a force acting on a roller shaft support differs depending on the state of belt tension.
Figure 12B:
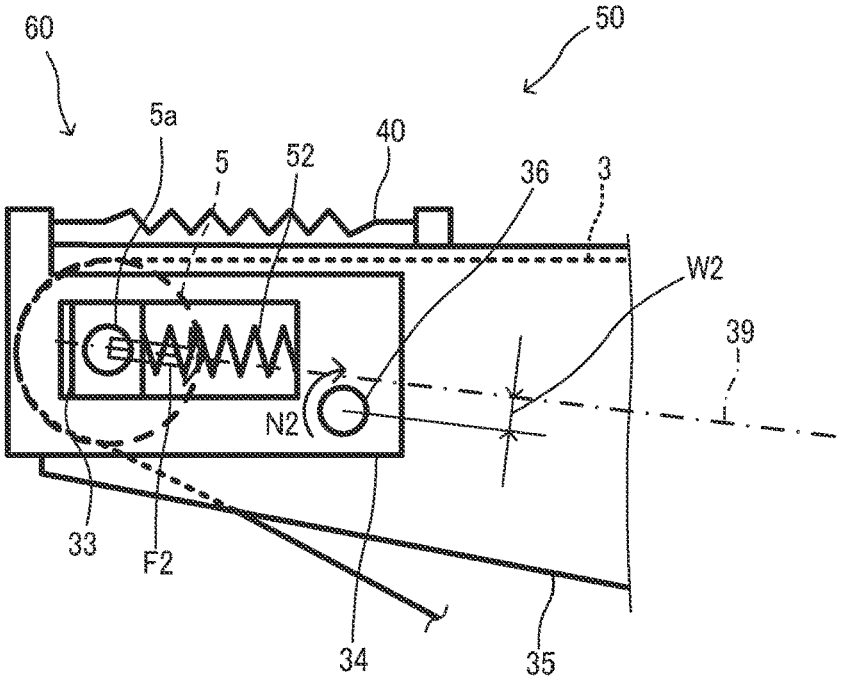

FIGS. 12A and 12B are schematic views illustrating that the force acting on the roller shaft support 34 differs depending on the state of the belt tension. FIG. 12A is a schematic view illustrating the tensioned state in which the entry roller 7 is at the tension applied position, and FIG. 12B is a schematic view illustrating the relaxed state in which the entry roller 7 is at the tension relaxed position.

In the tensioned state illustrated in FIG. 12A, a torque around the support rotation shaft 36 acting on the roller shaft support 34 by the belt tension, due to the belt tension is expressed as:

$$N1=F1\times W1,$$

where N1 represents the torque around the support rotation shaft 36 acting on the roller shaft support 34 by the belt tension, F1 represents a force received by the tension roller 5 from the intermediate transfer belt 3, W1 represents the distance from the belt bisector 39 to the support rotation shaft 36.

In the relaxed state illustrated in FIG. 12B, the torque around the support rotation shaft 36 acting on the roller shaft support 34 by the belt tension is expressed as:

$$N2=F2\times W2,$$

where N2 represents the torque around the support rotation shaft 36 acting on the roller shaft support 34 by the belt tension, F2 represents a force received by the tension roller 5 from the intermediate transfer belt 3, W2 represents the distance from the belt bisector 39 to the support rotation shaft 36.

In the relaxed state, since the force received by the tension roller 5 from the intermediate transfer belt 3 is reduced, the force F1 is greater than the force F2 (F1>F2). When the force received by the tension roller 5 from the intermediate transfer belt 3 decreases, the force in the direction to compress the tension spring 52 decreases, and the length of the tension spring 52 increases so as to approach its natural length. Therefore, the tension roller 5 moves to the left side in FIG. 12. Therefore, the distance W1 is greater than the distance W2 (W1>W2).

As a result, the torque acting in the direction of lifting the tension roller 5 is reduced by the amount expressed as N1−N2, that is, F1×W1−F2×W2.

The tension roller 5 is supported by the roller shaft support 34. As the roller shaft support 34 rotates counterclockwise in FIG. 12 around the support rotation shaft 36, the tension roller 5 descends. As the roller shaft support 34 rotates clockwise in FIG. 12, the tension roller 5 ascends.

In the intermediate transfer device 60, the torque acts so that the roller shaft support 34 is rotated clockwise in FIG. 12 by the tensile force of the support spring 40 and the belt tension (F1 or F2 in FIG. 12). A torque acts so that the roller shaft support 34 is rotated counterclockwise in FIG. 12 by the weight of the components attached to the roller shaft support 34 such as the tension roller 5.

In the tensioned state illustrated in FIG. 12A, the torque in the clockwise direction is larger than the torque in the counterclockwise direction in FIG. 12A, and a force that lifts the tension roller 5 acts. At that time, the stopped face 31*b* of the shaft inclining member 31 contacts the stopper face 35*d* of the guide portion 35*e* of the frame 35, and the tension roller 5 is positioned in the vertical direction.

On the other hand, in the relaxed state illustrated in FIG. 12B, the belt tension decreases (F1>F2) and the distance from the support rotation shaft 36 to the line indicating a direction of the force acting on the tension roller 5 (i.e., belt bisector 39) decreases (W1>W2). As a result, the torque (N1>N2) to rotate the roller shaft support 34 clockwise in FIG. 12 by the belt tension becomes small. Therefore, the torque in the clockwise direction in FIG. 12B, which is the sum of the torque N2 and the torque due to the tensile force of the support spring 40, becomes smaller than the above-described torque in the counterclockwise direction, so that the tension roller 5 descends.

Further, as the tension roller 5 moves downward, the distance W2 in FIG. 12B decreases, and further becomes minus. Therefore, as the tension roller descends, the force of lifting the tension roller 5 is further reduced.

Figure 27A:
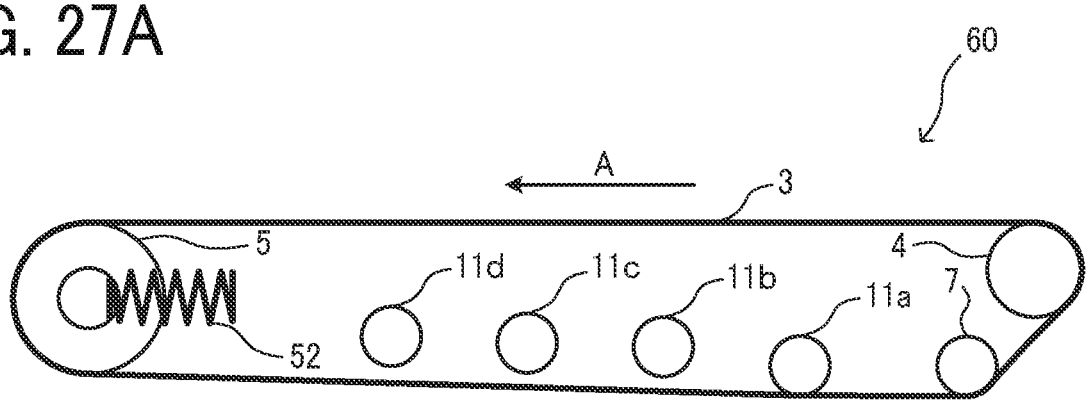
FIGS. 27A, 27B, and 27C are schematic views of the intermediate transfer device in which a problem may occur due to descent of the tension roller.
Figure 27B:
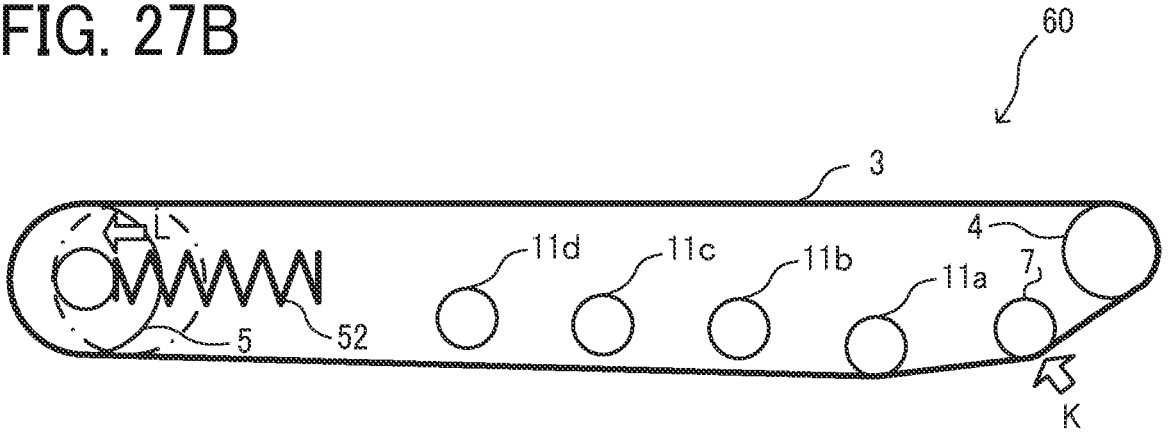
Figure 27C:
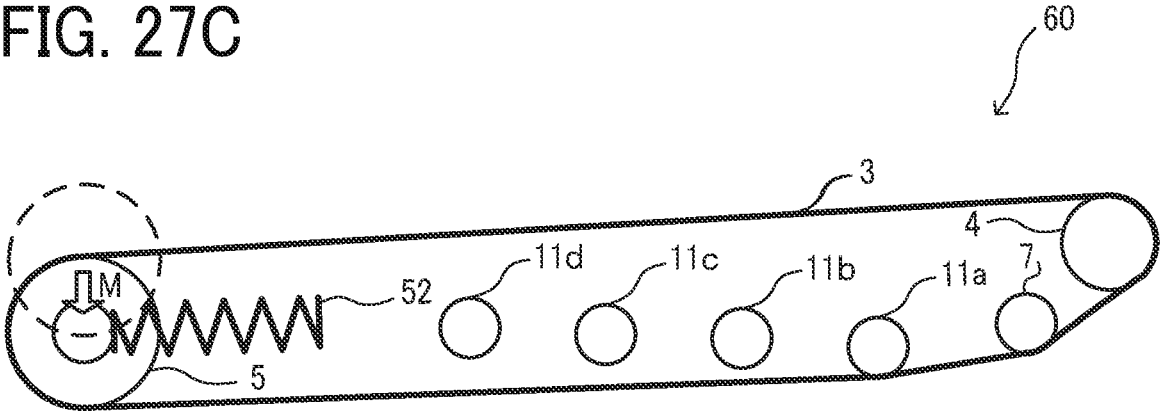

FIGS. 27A, 27B, and 27C are schematic views of the intermediate transfer device 60, which may cause problems due to the descent of the tension roller 5. In the tensioned state the tension roller 5 is lifted upward by the urging force of the support spring 40 and the belt tension, and the shaft inclining member 31 contacts the guide portion 35*e* as described above. On the other hand, in the relaxed state, as indicated by arrow K in FIG. 27B, the entry roller 7 moves toward the inside of the looped intermediate transfer belt 3, thereby reducing the belt tension. As the belt tension decreases, the tension roller 5 moves to the left indicated by arrow L in FIG. 27B by the urging force of the tension spring 52. As the belt tension decreases, the force of lifting the tension roller 5 decreases, and the tension roller 5 descends as indicated by arrow M in FIG. 27C. At that time, if the tension roller 5 or a component moving together with the tension roller 5 collides with another component constituting the intermediate transfer device 60, the intermediate transfer device 60 may be damaged.

Figure 13:
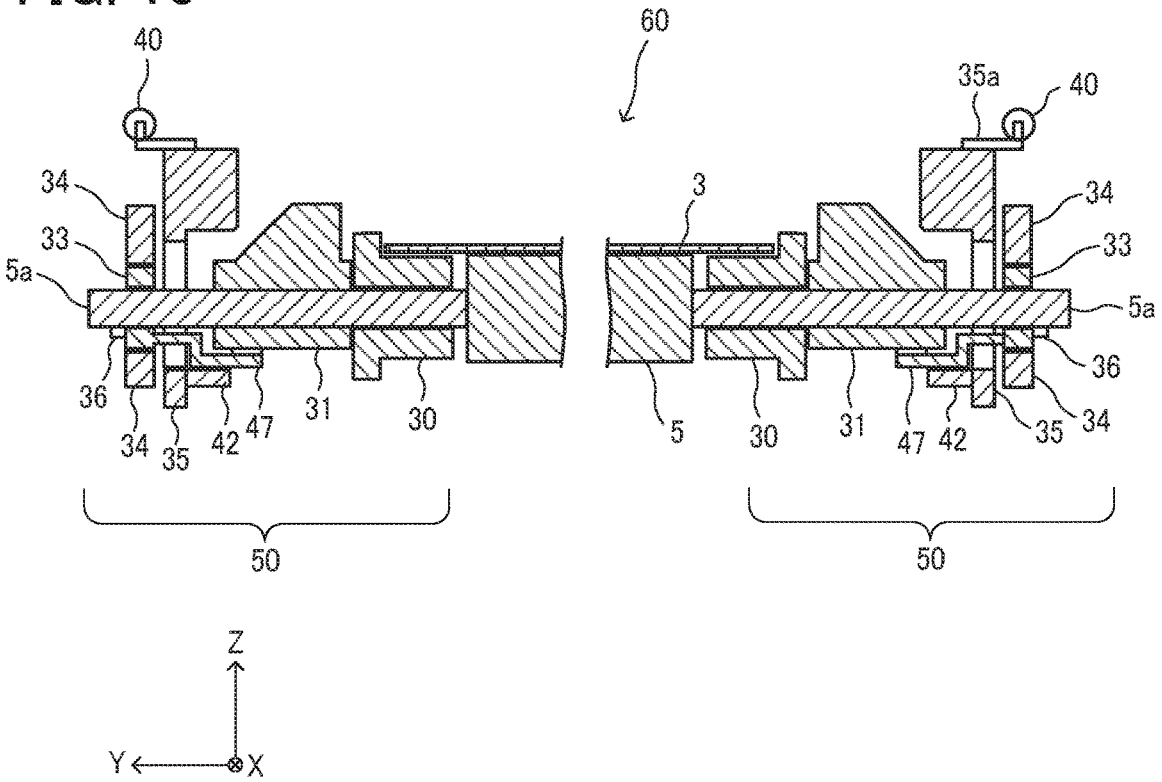
FIG. 13 is a schematic cross-sectional view of the intermediate transfer device in a relaxed state.

On the other hand, as illustrated in FIGS. 1, 6, etc., the intermediate transfer device 60 of the present embodiment includes a descent stopper 42 that keeps the descending range of the tension roller 5 within a predetermined range. FIG. 13 is a schematic view when the intermediate transfer device 60 becomes in the relaxed state from the state illustrated in FIG. 2, and FIG. 14 is an enlarged cross-sectional view of the right side end portion of the belt alignment unit 50 illustrated in FIG. 13.

Figure 14:
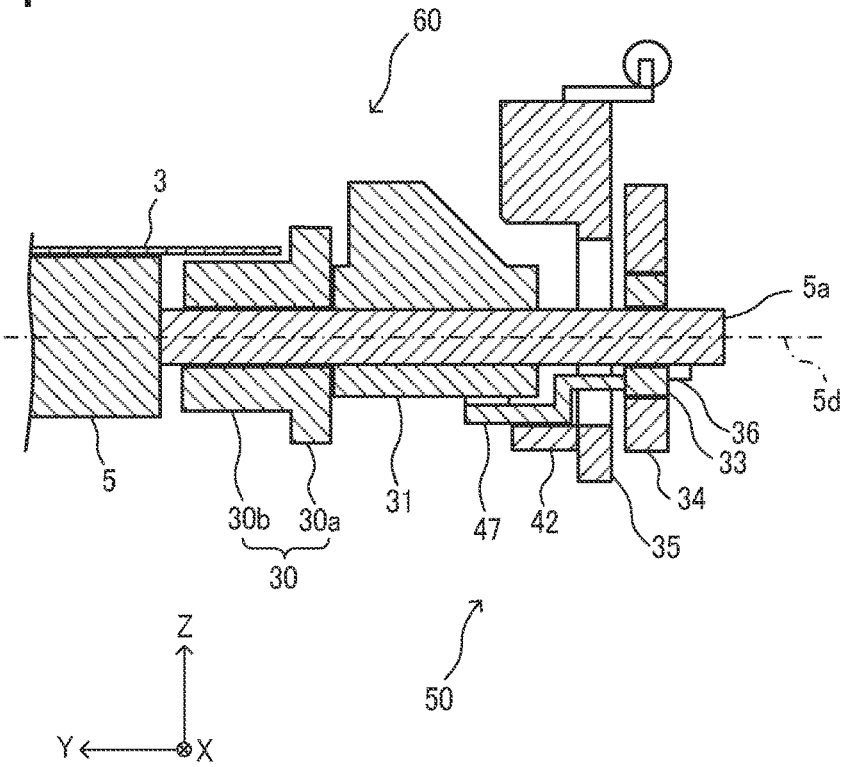
FIG. 14 is an enlarged cross-sectional view enlarging a right end portion of the belt alignment unit of the intermediate transfer device illustrated in FIG. 13.

As illustrated in FIGS. 13 and 14, when the tension roller 5 descends, the rotation stopper 47 that moves in the vertical direction together with the tension roller 5 also descends, and the rotation stopper 47 abuts against the descent stopper 42. Therefore, the tension roller 5 stops descending.

Figure 15A:
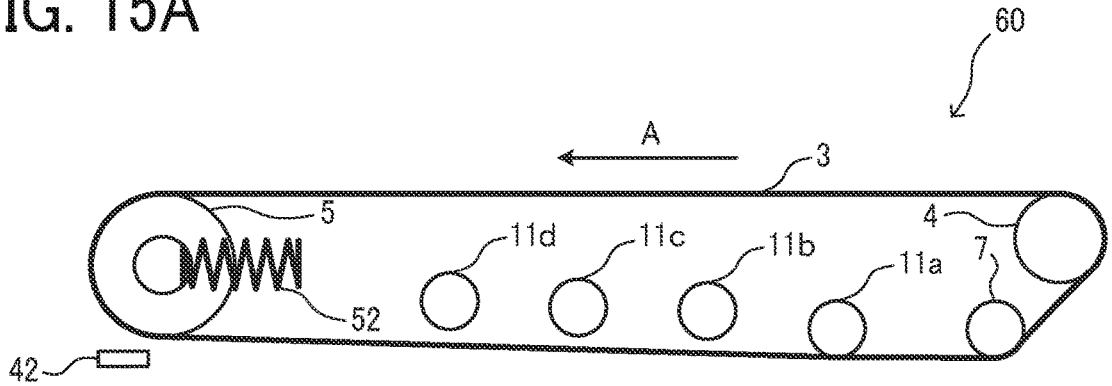
FIGS. 15A, 15B, and 15C are schematic views illustrating a process in which the tension roller descends due to relaxation of belt tension in the intermediate transfer device.
Figure 15B:
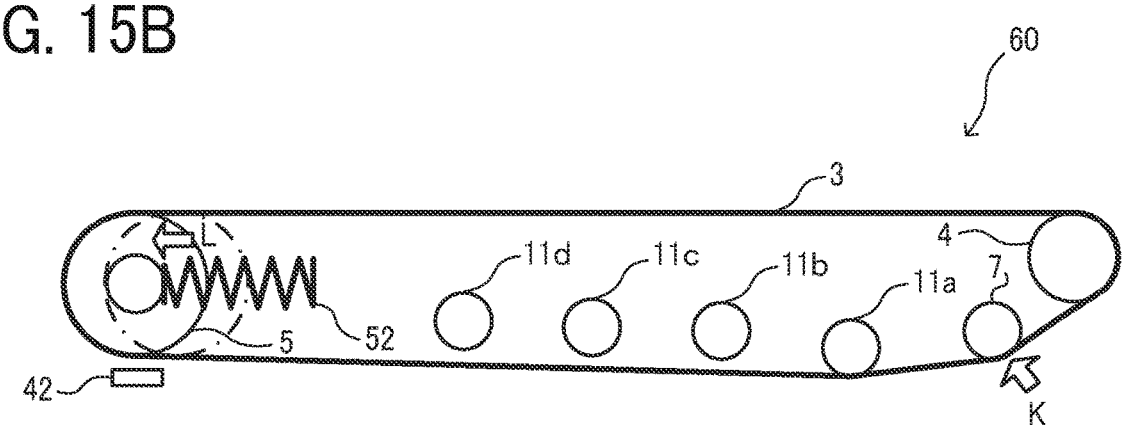
Figure 15C:
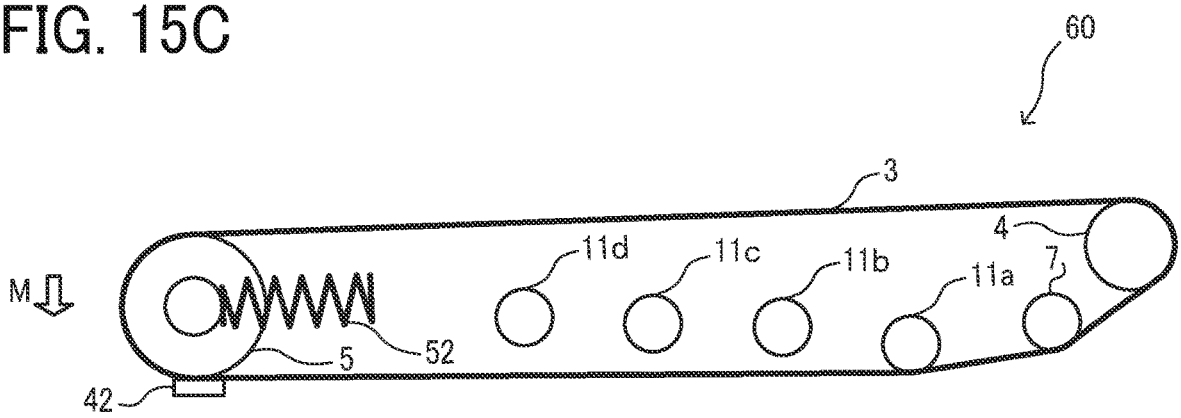

FIGS. 15A, 15B, and 15C are schematic views illustrating processes in which the tension roller 5 descends due to relaxation of belt tension in the intermediate transfer device 60 of the present embodiment. In the tensioned state, as described above, the tension roller 5 is lifted upward by the urging force of the support spring 40 and the belt tension (illustrated in FIG. 3), and the shaft inclining member 31 contacts the guide portion 35*e* (illustrated in FIG. 6). In the relaxed state, as indicated by arrow K in FIG. 15B, the entry roller 7 moves toward the inside of the looped intermediate transfer belt 3, thereby reducing the belt tension. As the belt tension decreases, the tension roller 5 moves to the left indicated by arrow L in FIG. 15B by the urging force of the tension spring 52. Further, as the belt tension decreases, the force of lifting the tension roller 5 decreases, and the tension roller 5 descends as indicated by arrow M in FIG. 15C. At that time, the rotation stopper 47 that moves in the vertical direction together with the tension roller 5 also descends, and the rotation stopper 47 contacts the descent stopper 42. Therefore, the tension roller 5 stops descending and does not descend further.

As illustrated in FIGS. 1, 6, etc., the descent stopper 42 is formed with the frame 35 as one united body, but the descent stopper 42 may be formed as a separated body.

In order to prevent the tension roller 5 from descending, it is conceivable to use a support spring 40 having a large spring constant and a strong tensile force.

However, if the support spring 40 is strong, the tension roller 5 is hardly inclined to correct the belt deviation when the intermediate transfer belt 3 moves toward one side in the axial direction, and the end portion in the width direction of the intermediate transfer belt 3 is likely to be damaged from the following reasons.

As described above, the torque to rotate the roller shaft support 34 clockwise in FIGS. 12A and 12B is caused by the tensile force of the support spring 40 and the belt tension. The torque acts so that the roller shaft support 34 is rotated counterclockwise in FIGS. 12A and 12B by the weight of the component attached to the roller shaft support 34 such as the tension roller 5. In a state in which the belt deviation does not occur, the torque for rotating the roller shaft support 34 in the clockwise direction in FIGS. 12A and 12B is larger than the torque in the counterclockwise direction, and the force for lifting the tension roller 5 acts. However, the stopped face 31*b* contacts the stopper face 35*d* and the tension roller 5 is positioned at that position.

When the belt deviation occurs, the end portion of the tension roller 5, to which the intermediate transfer belt 3 is drawn, is lowered, and the tension roller 5 is inclined, so that a force to correct the belt deviation is applied. When the intermediate transfer belt is drawn to one side, the force with which the end portion in the width direction of the intermediate transfer belt 3 presses the belt deviation follower 30 is converted to a force that lowers the end portion of the tension roller 5 in the axial direction by the inclined face 31*f* of the shaft inclining member 31. The force for lowering the end portion of the tension roller 5 at that time contributes to the torque for rotating the roller shaft support 34 in the counterclockwise direction in FIGS. 12A and 12B. When the torque becomes larger than the torque for rotating the roller shaft support 34 in the clockwise direction in FIGS. 12A and 12B, the axial end portion of the tension roller 5 descends and the shaft of the tension roller 5 is inclined.

If the support spring 40 is strong, the torque for rotating the roller shaft support 34 in the clockwise direction in FIGS. 12A and 12B increases, and the force for lifting the tension roller 5 increases. At that time, even when a belt deviation occurs and the end face of the intermediate transfer belt 3 contacts the flange 30*a* to generate the force for lowering the axial end portion of the tension roller 5, the end portion of the tension roller 5 is not lowered unless the force for lowering is greater than the force for lifting.

In a state in which the axial end portion of the tension roller 5 does not descend, a force for correcting the belt deviation does not act. Similarly to the configuration in which the end face of the belt member is pushed back by the above-described belt abutting member, the end face of the intermediate transfer belt 3 remains receiving the stress. Even when the axial end portion of the tension roller 5 descends, the end face of the intermediate transfer belt 3 is pressed against the flange 30*a* with a strong contact pressure as the lowering force greater than the above-described lifting force acts. In this state as well, the end face of the intermediate transfer belt 3 remains receiving the stress. If the end face of the intermediate transfer belt 3 remains receiving the stress, damage such as cracks are likely to occur, and the durability life of the intermediate transfer belt 3 may decrease.

On the other hand, the intermediate transfer device 60 of the present embodiment includes the descent stopper 42 and can prevent a problem caused by descent of the tension roller 5 without using the support spring 40 having a strong tensile force. Therefore, it is also possible to prevent a problem caused by using the above-mentioned support spring 40 having a strong tensile force.

In the intermediate transfer device 60 of the present embodiment, the rotation stopper 47 abuts against the descent stopper 42 and stops descending. Alternatively, a member that abuts against the descent stopper 42 is not limited the rotation stopper 47. When the descent stopper 42 is disposed to stop such a member that moves in the vertical direction together with the tension roller 5, such as the belt deviation follower 30 or the shaft inclining member 31, the tension roller 5 is inhibited from descending. Further, in the intermediate transfer device 60 of the present embodiment, the descent stopper 42 is disposed so as to protrude inward from the frame 35. Alternatively, the descent stopper 42 may be disposed so as to protrude outward from the frame 35. In this case, as the tension roller 5 descends, the roller shaft support 34 abuts against the descent stopper 42, and the tension roller 5 can be prevented from descending.

As described above, the intermediate transfer device 60 as the belt device includes the intermediate transfer belt 3 as an endless belt. The intermediate transfer device 60 further includes the tension roller 5 as a first support rotator and the entry roller 7 as a second support rotator. The tension roller 5 around which the intermediate transfer belt 3 is looped and stretched is movable with respect to the body of the intermediate transfer device 60 and can be inclined with respect to the secondary transfer backup roller 4. The entry roller 7 is movable with respect to the body of the intermediate transfer device 60. The intermediate transfer device 60 yet further includes the secondary transfer backup roller 4 as a non-movable support rotator that is rotatable but does not change the position thereof with respect to the body of the intermediate transfer device 60.

Figure 16:
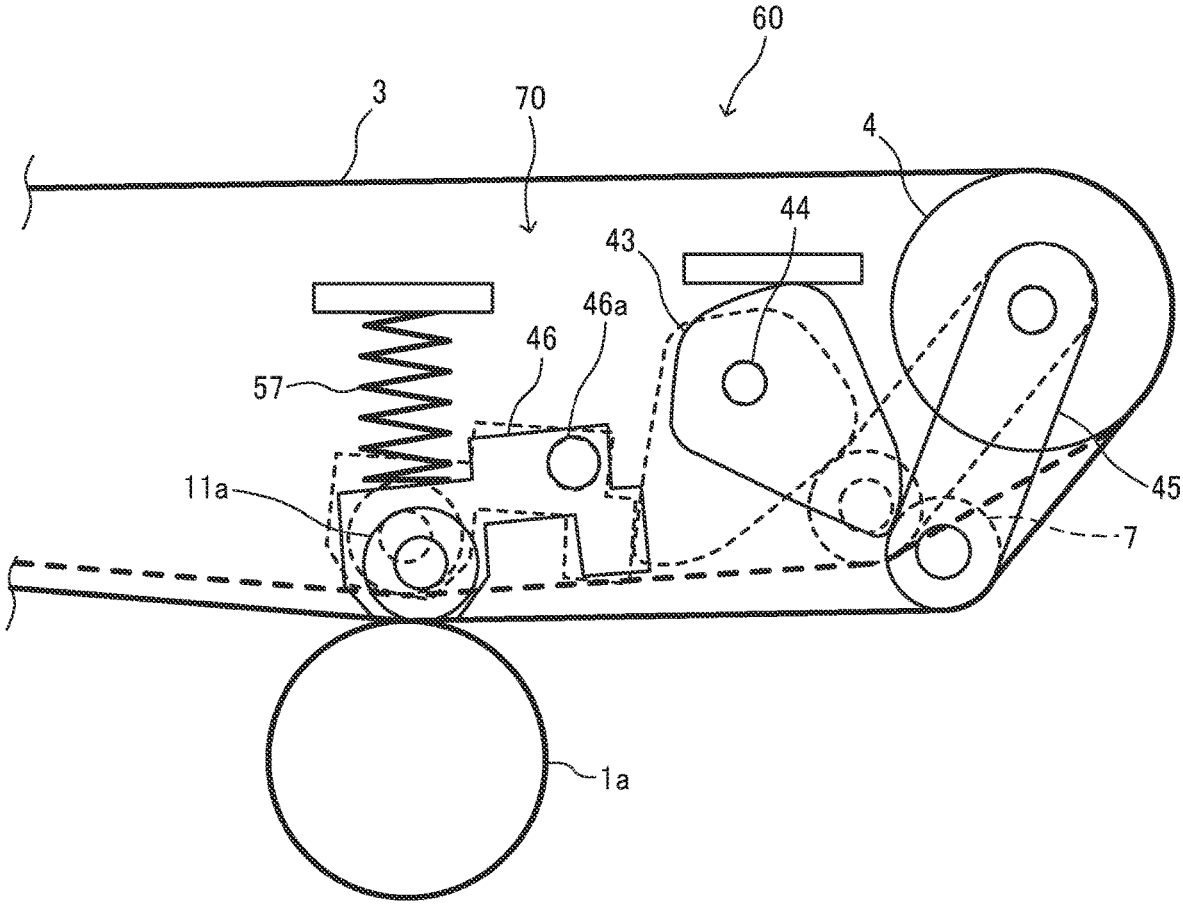
FIG. 16 is a schematic view of an end portion in the width direction of a retraction mechanism for an entry roller in a tensioned state.
Figure 17:
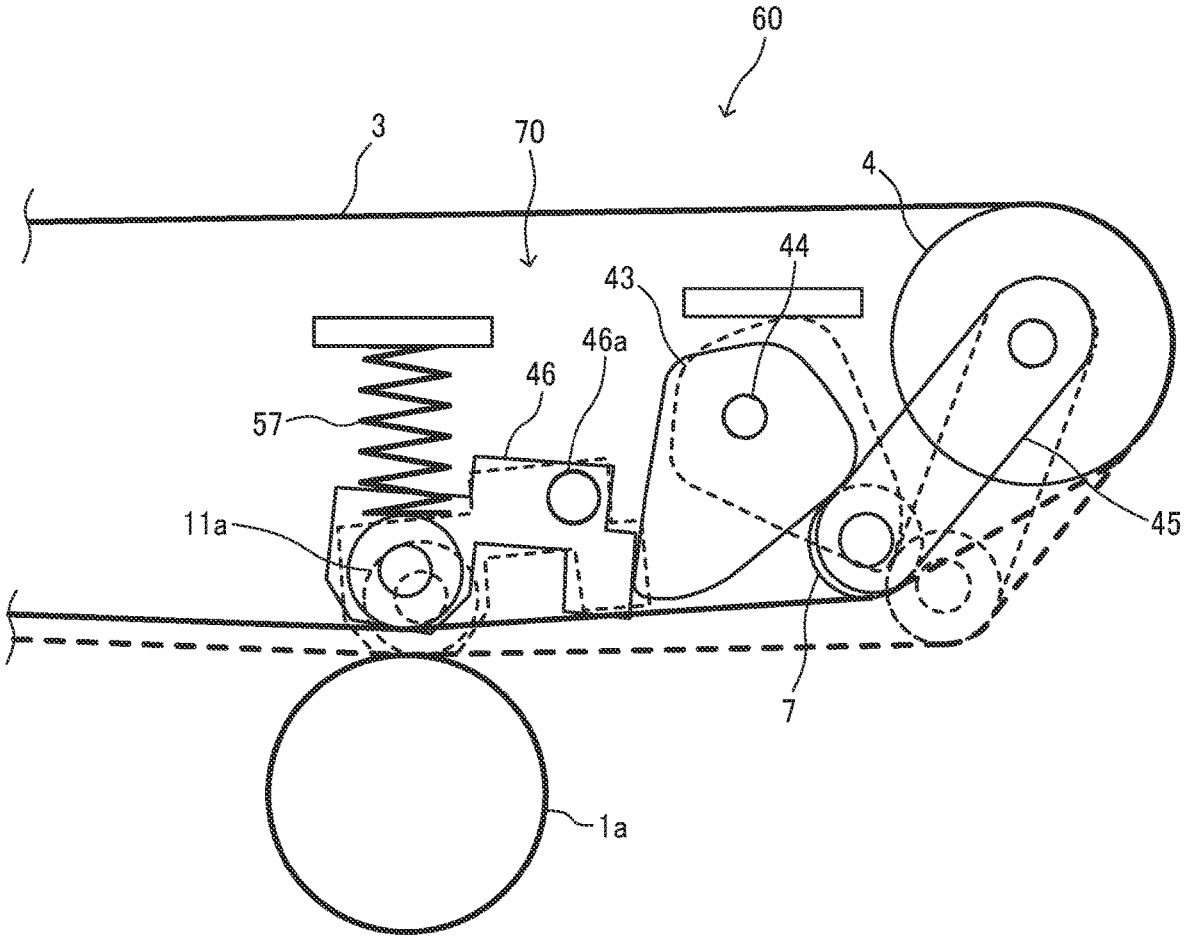
FIG. 17 is a schematic view of the end portion in the width direction of the retraction mechanism for the entry roller in the relaxed state.

The intermediate transfer device 60 yet further includes a retraction mechanism 70 illustrated in FIGS. 16 and 17, serving as a tension adjuster, that moves the entry roller 7 toward the inside of the looped intermediate transfer belt 3 to relax the belt tension and reduce the force applied to the entry roller 7. The intermediate transfer device 60 yet further includes the belt alignment unit 50 that inclines the tension roller 5 to correct the belt deviation.

Furthermore, the intermediate transfer device 60 includes the descent stopper 42 that prevents the tension roller 5 from descending and falling when the entry roller 7 is moved by the retraction mechanism 70.

In the intermediate transfer device 60, the retraction mechanism 70 functions as the curling prevention mechanism, and the belt alignment unit 50 functions as a belt walk correction mechanism.

In order to prevent the curling, as the entry roller 7 is moved to the tension relaxed position, the tension spring 52 expands by the amount of decrease in the belt tension, and the tension roller 5 is moved to the left. Since the tension spring 52 expands, the belt tension decreases, and the force received by the tension roller 5 from the intermediate transfer belt 3 decreases. As a result, the torque for lifting the tension roller 5 decreases, and the tension roller 5 descends. At that time, the rotation stopper 47 that moves in the vertical direction together with the tension roller 5 abuts against the descent stopper 42. Therefore, the tension roller 5 stops descending.

In this way, in the intermediate transfer device 60, the descent stopper 42 prevents the problem that the tension roller 5 descends as the force for lifting the tension roller 5 decreases when the belt tension is relaxed. This configuration can correct belt walk with the curling inhibited while minimizing interference with peripheral devices or breakage of the intermediate transfer device 60 caused by descent of the tension roller 5.

Next, the retraction mechanism 70 for retracting the entry roller 7 from the tension applied position to the tension relaxed position is described.

Figure 18:
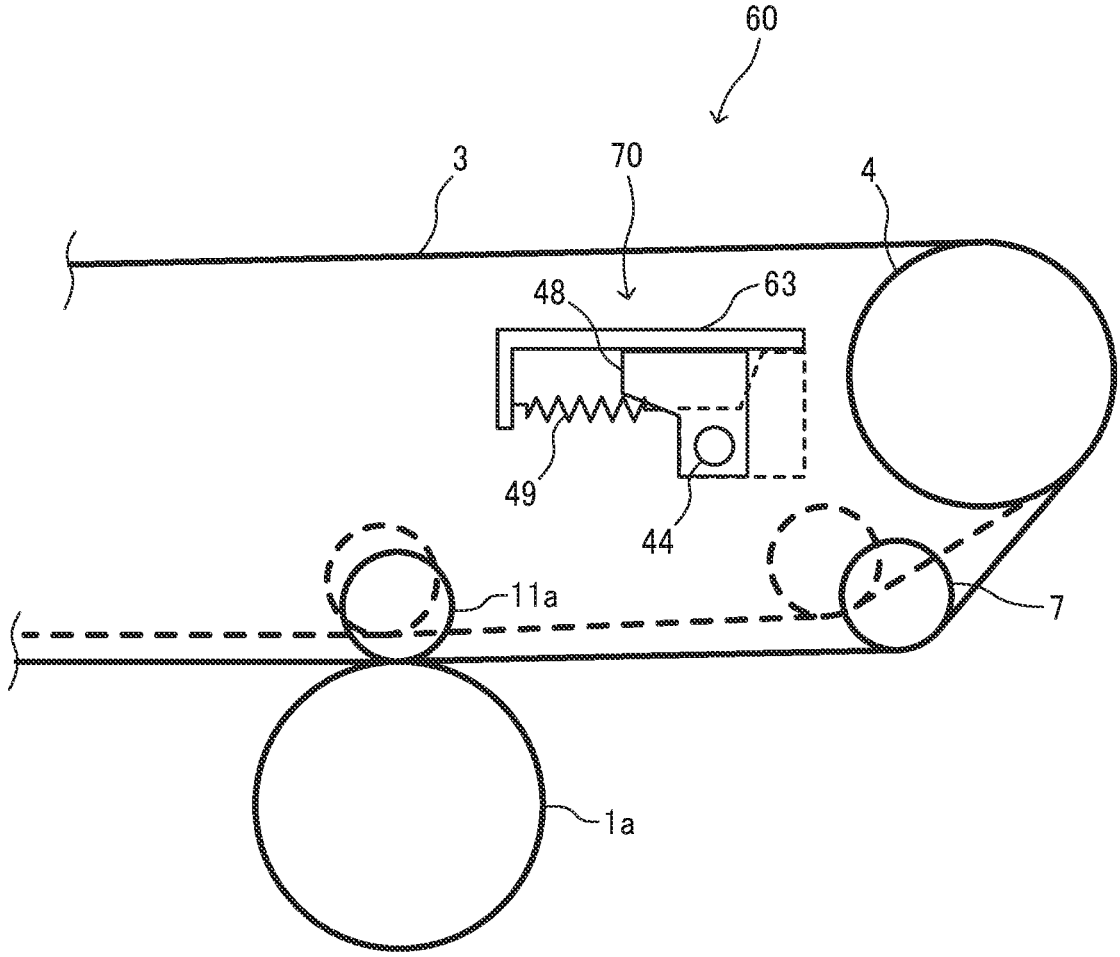
FIG. 18 is a schematic view of a central portion in the width direction of the retraction mechanism in the tensioned state.
Figure 19:
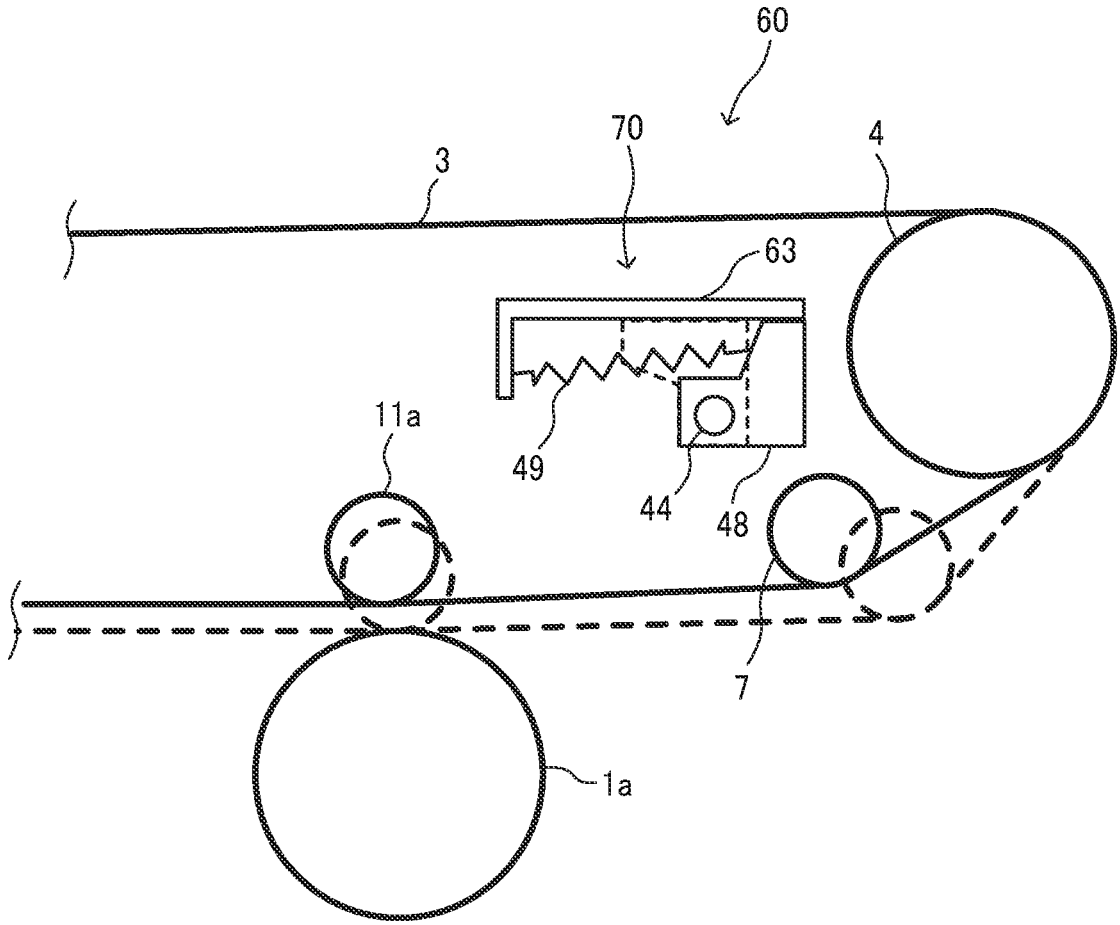
FIG. 19 is a schematic view of the central portion in the width direction of the retraction mechanism in the relaxed state.
Figure 20:
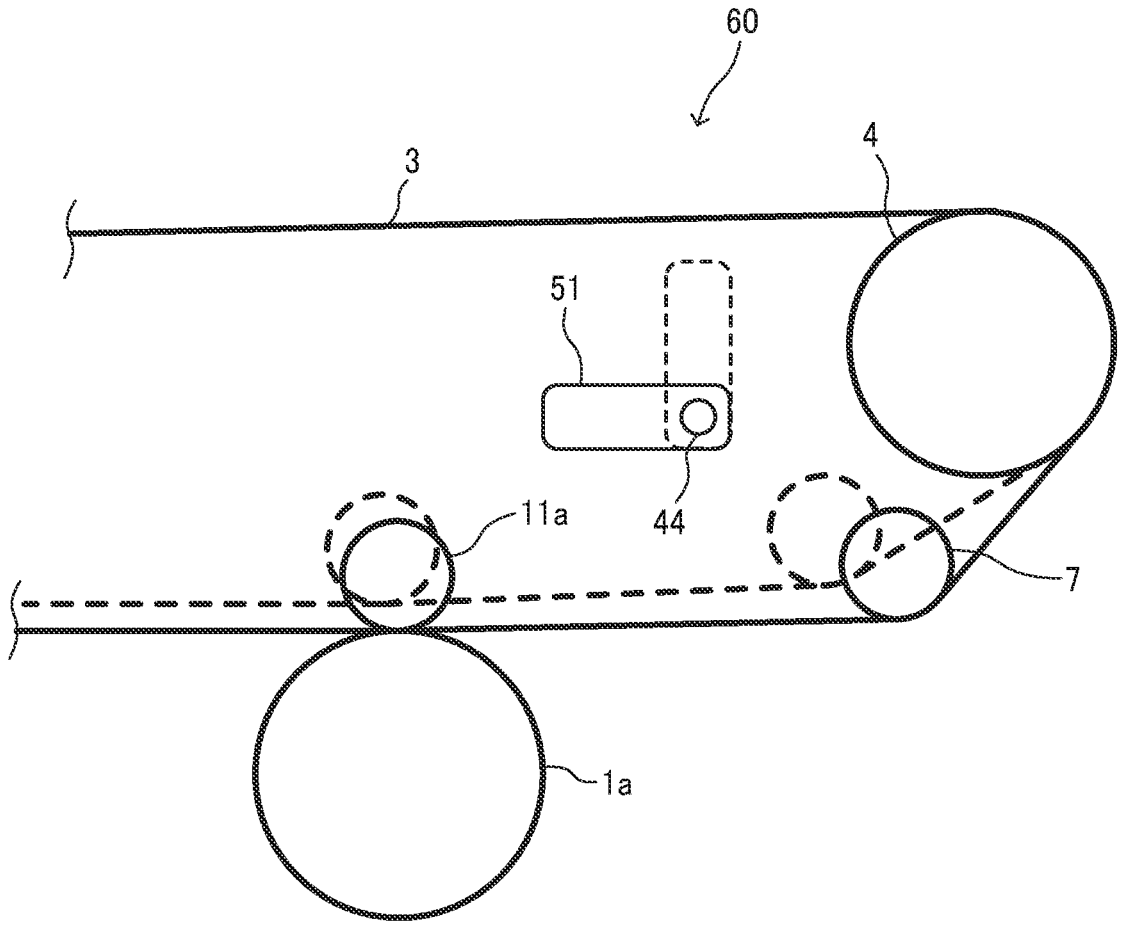
FIG. 20 is a schematic view of a retraction lever in the tensioned state.
Figure 21:
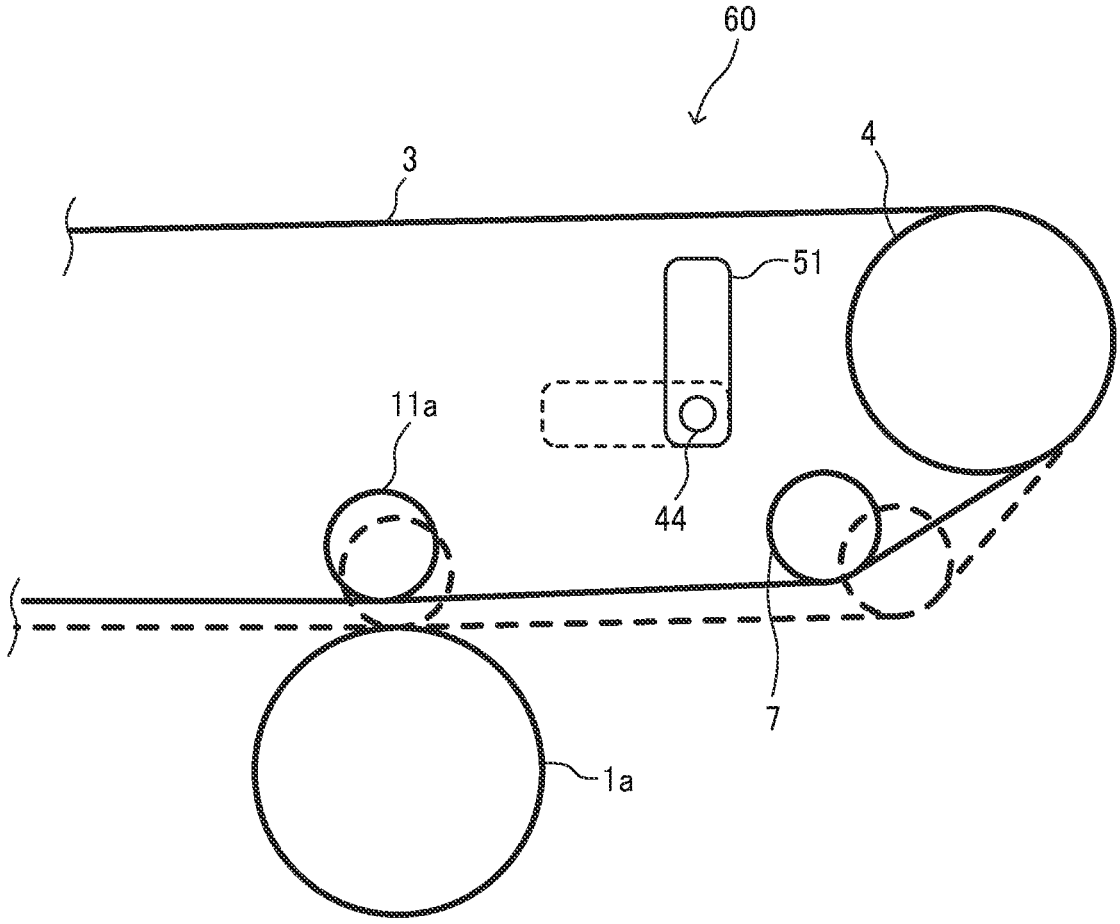
FIG. 21 is a schematic view of the retraction lever in the relaxed state.

FIGS. 16 through 21 are schematic views of the retraction mechanism 70. FIGS. 16 and 17 are the schematic views of the end portion in the width direction (the front-back direction in FIGS. 16 through 21) of the retraction mechanism 70. FIG. 16 is an illustrative example in the tensioned state, FIG. 17 is an illustrative example in the relaxed state. FIGS. 18 and 19 are the schematic views of the center portion in the width direction of the retraction mechanism 70. FIG. 18 is an illustrative example in the tensioned state, FIG. 19 is an illustrative example in the relaxed state. FIGS. 20 and 21 are the schematic views of a retraction lever 51 that operates the retraction mechanism 70. FIG. 20 is an illustrative example in the tensioned state, FIG. 21 is an illustrative example in the relaxed state. As illustrated in FIGS. 16 through 21, the retraction mechanism 70 includes an entry lever 45, first retraction cams 43, a cam rotation shaft 44, a second retraction cam 48, a retraction cam spring 49, a cam stopper 63, and the retraction lever 51 and the like. The first retraction cam 43, the second retraction cam 48, and the retraction lever 51 are secured to the cam rotation shaft 44. One first retraction cam 43 is disposed at each of the front and rear ends in the depth direction of the intermediate transfer device 60 (the front-back direction in FIGS. 16 through 21). One second retraction cam 48 is disposed at the center in the depth direction of the intermediate transfer device 60, and one retraction lever 51 is disposed at the front end in the depth direction of the intermediate transfer device 60.

The intermediate transfer device 60 removable from the apparatus body housing 101 of the printer 100 is removably installed in the apparatus body housing 101 in a state indicated by a solid line in FIG. 21. At that time, the entry roller 7 and the primary transfer roller 11*a* for black are retracted from the regular position (the position at the time of image formation).

As the retraction lever 51 is manually rotated in the counterclockwise direction in FIG. 21 in this state, the state illustrated in FIG. 20 is obtained. The movement of the entry roller 7 and the primary transfer roller 11*a* for black at that time is described with reference to FIGS. 16 and 17.

In this state illustrated in FIG. 17, the positions of the entry roller 7 and the primary transfer roller 11*a* for black are in the retracted state. As the retraction lever 51 is rotated from the retracted state, the first retraction cam 43 rotates together with the cam rotation shaft 44 in the counterclockwise direction. Accordingly, the entry lever 45 that rotatably supports the entry roller 7 is pushed by the first retraction cam 43 and rotates in the counterclockwise direction in FIG. 17 around the rotation axis of the secondary transfer backup roller 4. Therefore, the entry roller 7 is positioned to a non-retracted (normal) position as illustrated in FIG. 16.

The primary transfer roller 11*a* for black is rotatably supported around a bracket rotation shaft 46*a* by the primary transfer bracket 46 for black. A primary transfer spring 57 for black urges the primary transfer roller 11*a* for black to abut against the photoconductor 1*a* for black via the intermediate transfer belt 3. In the state illustrated in FIG. 17, the first retraction cam 43 abuts against the primary transfer bracket 46 for black and presses the primary transfer bracket 46 for black in the direction against the urging force of the primary transfer spring 57 for black. Thus, the primary transfer roller 11*a* for black is in the retracted state from the normal position.

As the retraction lever 51 rotates from the state illustrated in FIG. 17, the first retraction cam 43 rotates together with the cam rotation shaft 44 in the counterclockwise direction. Therefore, the primary transfer bracket 46 for black is not pressed by the first retraction cam 43, and the primary transfer bracket 46 for black rotates in the counterclockwise direction in FIG. 17 around the bracket rotation shaft 46*a* by the urging force of the primary transfer spring 57 for black. As a result, the primary transfer roller 11*a* for black supported by the primary transfer bracket 46 for black presses against the photoconductor 1*a* for black via the intermediate transfer belt 3.

In order to hold the position of the entry roller 7 and the primary transfer roller 11*a* for black in the retracted state or the non-retracted (normal) state, respectively, the second retraction cam 48 and the cam stopper 63 are disposed at the center portion in the width direction of the intermediate transfer device 60.

FIG. 19 illustrates the position of the second retraction cam 48 when the entry roller 7 is in the retracted position. As the retraction lever 51 rotates in the counterclockwise direction from the state illustrated in FIG. 19, the second retraction cam 48 rotates counterclockwise while bending the cam rotation shaft 44. As a result, the non-retracted position illustrated in FIG. 18 can be set, and the non-retracted state can be held.

Next, the belt contact-separation mechanism 80 of the primary transfer roller 11 is described.

Figure 22:
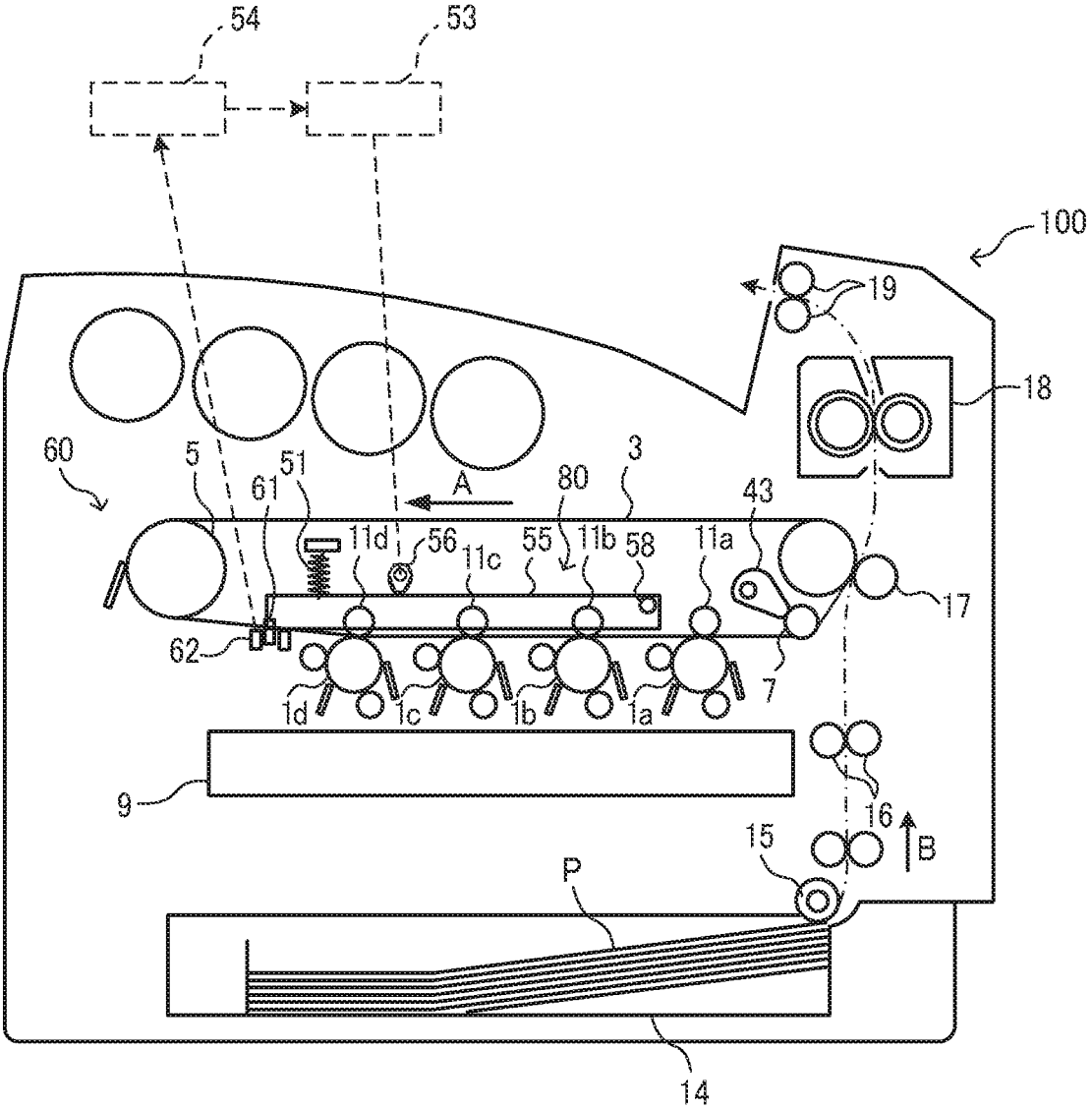
FIG. 22 is a schematic view of the printer illustrating a belt contact-separation mechanism in a contact state.
Figure 23:
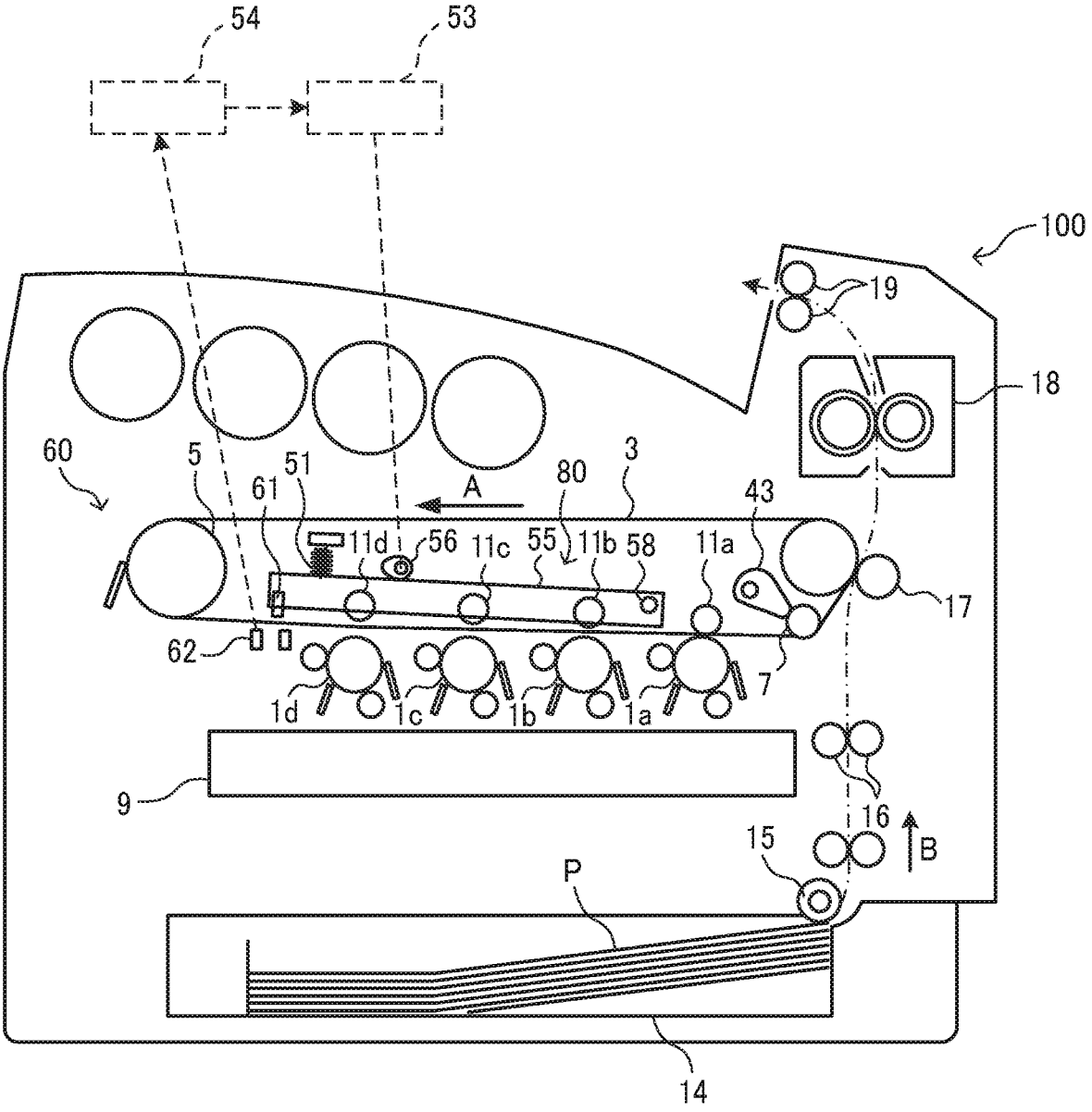
FIG. 23 is a schematic view of the printer illustrating a belt contact-separation mechanism in a separated state.

FIGS. 22 and 23 are schematic views of the printer 100 illustrating a contact-separation mechanism of three primary transfer rollers 11*b*, 11*c*, and 11*d* except for primary transfer roller 11*a* for black. FIG. 22 is the schematic view of the printer 100 in the contact state, and FIG. 23 is a schematic view of the printer 100 in a separated state.

The primary transfer roller 11*a* for black of the four primary transfer rollers 11*a*, 11*b*, 11*c*, and 11*d*, used for black image transfer, is supported by the retraction mechanism 70 so as to contact and separate from the photoconductor 1*a* for black. The other primary transfer rollers 11*b*, 11*c*, and 11*d* are rotatably supported by a transfer roller holder 55. One end of the transfer roller holder 55 is pivotably supported around a contact-separation shaft 58 with respect to the body of the intermediate transfer device 60. The transfer roller holder 55 is pivoted as a contact-separation motor 53 rotates a contact-separation cam 56.

A controller 54 controls the contact-separation motor 53 to control the rotational position of the contact-separation cam 56, thereby switching between the contact state illustrated in FIG. 22 and the separated state illustrated in FIG. 23.

In the contact state illustrated in FIG. 22, the three primary transfer rollers 11*b*, 11*c*, and 11*d* supported by the transfer roller holder 55 are in contact with the three photoconductors 1*b*, 1*c*, and 1*d* via the intermediate transfer belt 3 (i.e., contact position). In the separated state illustrated in FIG. 23, the three primary transfer rollers 11*b*, 11*c*, and 11*d* supported by the transfer roller holder 55 are separated from the intermediate transfer belt 3, and the intermediate transfer belt 3 is separated from the three photoconductors 1*b*, 1*c*, and 1*d* (i.e., separated position).

In the configuration illustrated in FIGS. 22 and 23, the belt contact-separation mechanism 80 includes the transfer roller holder 55, the contact-separation shaft 58, the contact-separation motor 53, and the contact-separation cam 56.

A detection piece 61 is secured to the other end of the transfer roller holder 55, and a light transmission contact-separation sensor 62 is disposed on the movement path of the detection piece 61 that is pivoted together with the transfer roller holder 55. When the transfer roller holder 55 is at the contact position, the detection piece 61 blocks light transmission of the contact-separation sensor 62, thereby setting the contact-separation sensor 62 to "OFF" state. When the transfer roller holder 55 is at the separated position, the contact-separation sensor 62 detects light transmission, thereby setting the contact-separation sensor 62 to "ON" state.

In the monochrome mode, the transfer roller holder 55 is positioned at the separated position by the belt contact-separation mechanism 80, and only the photoconductor 1*a* for black among the four photoconductors 1 rotates to form a toner image. In the full-color mode, the transfer roller holder 55 is positioned at the contact position by the belt contact-separation mechanism 80, and the four photoconductors 1*a*, 1*b*, 1*c*, and 1*d* rotate, respectively, to form the toner image as described above. At the standby time of the printer 100, the transfer roller holder 55 is at the separated position, and the contact-separation sensor 62 is in the "ON" state.

Next, installation and removal of the intermediate transfer device 60 from the apparatus body of the printer 100 are described.

Figure 24:
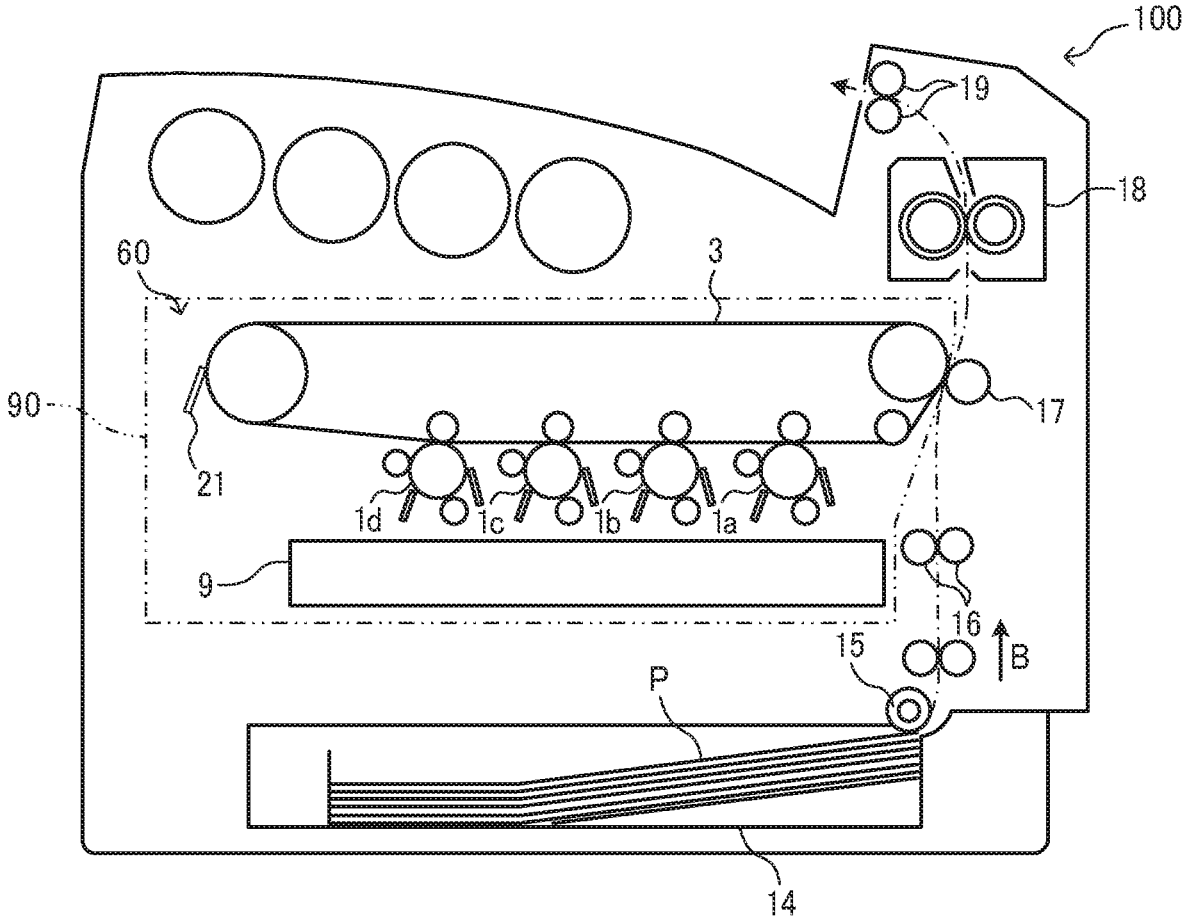
FIG. 24 is a schematic view of the printer illustrating a front opening of an apparatus body.

FIG. 24 is a schematic view of the printer 100 illustrating a front opening 90 of the apparatus body that is opened when the intermediate transfer device 60 is installed and removed. A two-dot chain line in FIG. 24 indicates an edge of the front opening 90.

A direction in which the intermediate transfer device 60 is installed in and removed from the apparatus body of the printer 100 is the front-rear direction of the printer 100 (direction perpendicular to the surface of the paper on which FIG. 24 is drawn).

As described above, primary-transfer roller contact-separation mechanisms are provided so that the intermediate transfer belt 3 and the photoconductors 1 do not contact when the intermediate transfer device 60 is installed or removed.

There are two types of contact-separation mechanisms for the primary transfer rollers 11*a*, 11*b*, 11*c*, and 11*d*: one for yellow, magenta, and cyan; and one for black. The contact-separation for the primary transfer rollers 11*b*, 11*c*, and 11*d* for magenta, cyan, and yellow is performed by the belt contact-separation mechanism 80 using the contact-separation sensor 62 described with reference to FIGS. 22 and 23. The contact-separation state of the primary transfer roller 11*a* for Bk is manually switched at the time of installation and removal of the intermediate transfer device 60 by the retraction mechanism 70 for the entry roller 7 described with reference to FIGS. 16 to 21.

When the image formation has finished or the front opening 90 is opened, in the belt contact-separation mechanism 80, the controller 54 drives the contact-separation motor 53 and rotates a contact-separation cam 56, thereby separating three primary transfer rollers 11*b*, 11*c*, and 11*d* from the intermediate transfer belt 3. As a result, the intermediate transfer belt 3 separates from the photoconductors 1*b*, 1*c*, and 1*d* for magenta, cyan, and yellow.

Figure 25A:
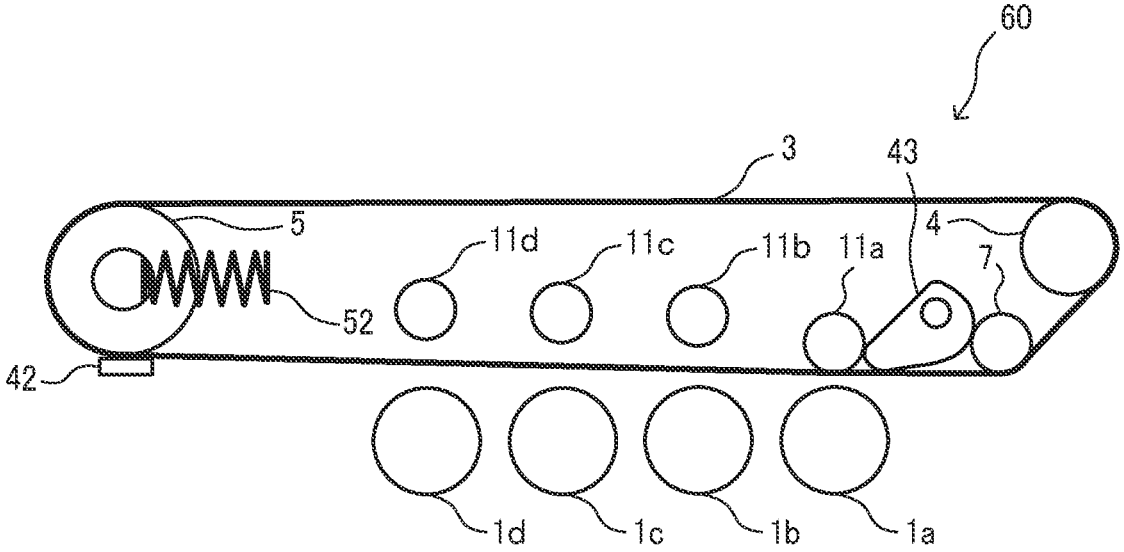
FIGS. 25A and 25B are schematic views of the intermediate transfer device and photoconductors at the time of mounting and after mounting.
Figure 25B:
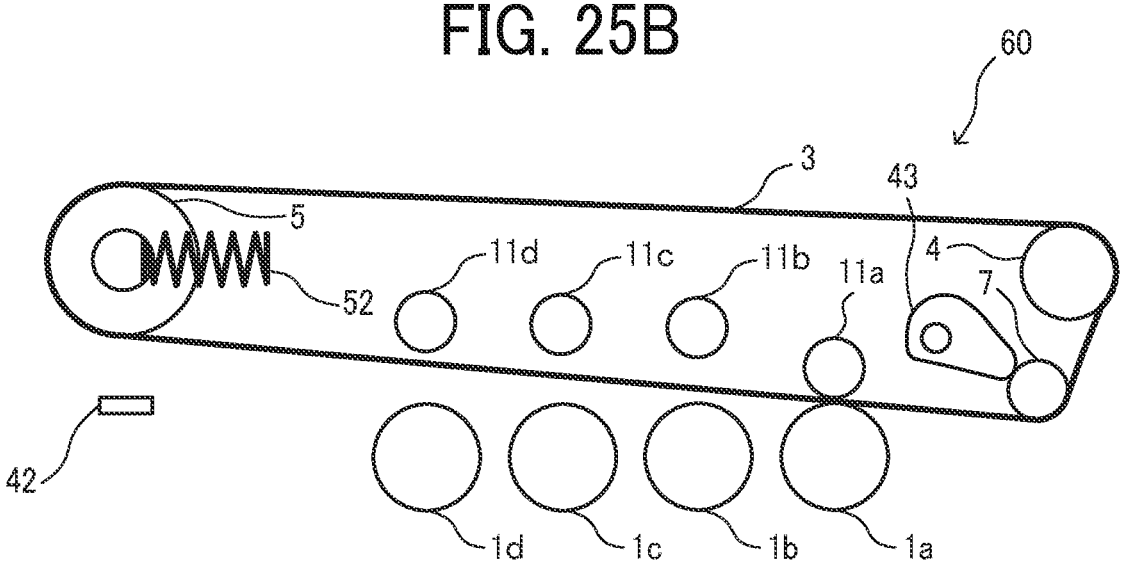

FIGS. 25A and 25B are schematic views of the intermediate transfer device 60 and the photoconductors 1 at the time of mounting and after mounting, FIG. 25A is the schematic view at the time of mounting, and FIG. 25B is the schematic view after mounting.

As described with reference to FIGS. 16 through 21, in the printer 100, the contact-separation operation of the primary transfer roller 11*a* for black is interlocked with the retraction mechanism 70 for the entry roller 7.

As illustrated in FIG. 25A, when the primary transfer roller 11*a* for black and the intermediate transfer belt 3 are separated from the photoconductor 1*a* for black and the entry roller 7 is in the tension relaxed position, the intermediate transfer device 60 is mounted in the apparatus body of the printer 100. Thereafter, the retraction lever 51 is manually rotated, and the first retraction cam 43 rotates. Accordingly, as illustrated in FIG. 25B, the intermediate transfer belt 3 at a position in contact with the primary transfer roller 11*a* for black abuts against the photoconductor 1*a* for black. At that time, the entry roller 7 moves to the tension applied position.

As described above, the contact-separation operation of the primary transfer roller 11*a* for black and the tension relaxation operation of the entry roller 7 are performed at the same time by a common mechanism (i.e., retraction mechanism 70), and the state of the intermediate transfer device 60 in transportation is same as the state for the installation and removal to the apparatus body of the printer 100. This configuration can improve an operability of installation and removal of the intermediate transfer device 60.

Figure 26:
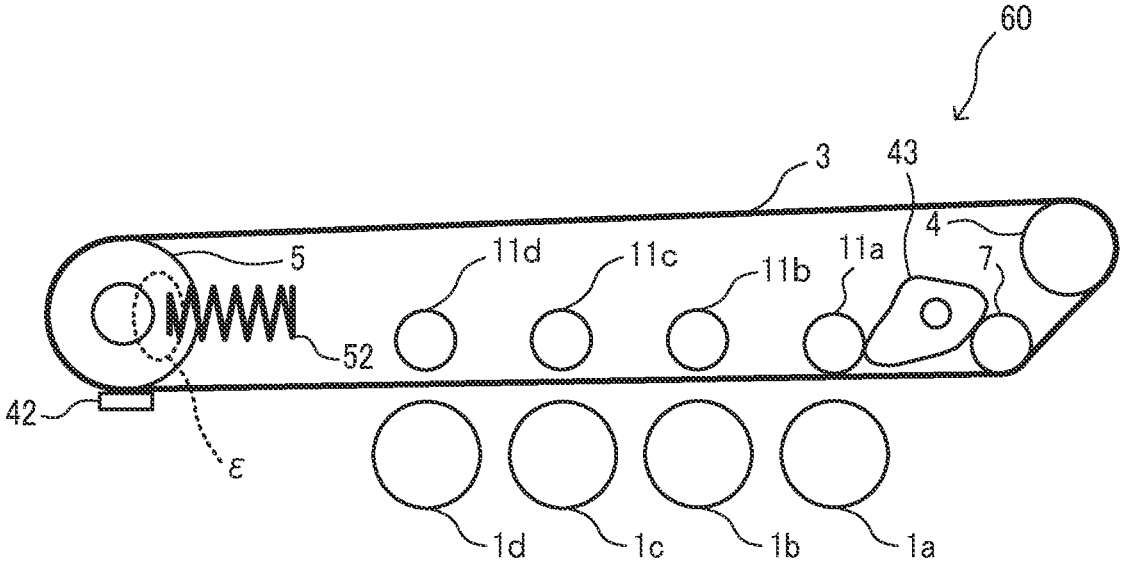
FIG. 26 is schematic view of the intermediate transfer device in a state in which the belt tension is 0.

Further, it is desirable that the belt tension adjuster such as the retraction mechanism 70 maintain at least some tension on the belt when the entry roller 7 moves to the tension relaxed position. FIG. 26 is a schematic view of the intermediate transfer device 60 when the belt tension is zero. In the relaxed state, if the tension roller 5 is movable to the left side in FIG. 26 from the natural length of the tension spring 52, the tension spring 52 and the tension roller 5 separate from each other as indicated by dashed oval "ε" in FIG. 26. When the tension spring 52 and the tension roller 5 separate from each other, the urging force of the tension spring 52 does not act on the intermediate transfer belt 3, and the belt tension becomes 0. In this state, the intermediate transfer belt 3 may become loose, interfere with surrounding components, and be damaged.

Therefore, the tension relaxed position of the entry roller 7 is set so that, even in the relaxed state, the length of the tension spring 52 is shorter than the natural length and the compressed state is maintained. As a result, it is possible to prevent problems caused by loosening of the intermediate transfer belt 3. The position of the entry roller 7 is appropriately set by the shape of the first retraction cam 43.

The position of the descent stopper 42 is set so that the intermediate transfer device 60 does not interfere with the apparatus body of the printer 100 at the time of installation and removal from the apparatus body of the printer 100. Specifically, the front opening 90 of the apparatus body is larger than the intermediate transfer device 60 including the descent stopper 42. Therefore, with this configuration, the intermediate transfer device 60 does not contact the apparatus body of the printer 100 at the time of installation and removal.

In the above-described embodiment, the belt alignment unit 50 that corrects the belt deviation, that is, the intermediate transfer belt 3 moves to one side in the width direction, has been described. Note that the belt, deviation of which is corrected by the belt alignment unit 50 of the present embodiment, is not limited to the intermediate transfer belt 3. For example, the present disclosure is also applicable to a configuration for correcting belt deviation of a transfer conveyance belt of a transfer device. The transfer conveyance belt conveys a recording medium through a conveyance path including a transfer position where an image is transferred onto a recording medium such as transfer paper in an image forming apparatus. Furthermore, the belt device according to the present disclosure is adaptable for various belt devices such as a conveyor belt that convey materials or products in a factory as well as the belt device in the image forming apparatus.

The exemplary embodiments described above are examples and aspects of this disclosure attain advantages below, respectively.

Aspect A

A belt device such as the intermediate transfer device 60 includes a plurality of support rotators such as the secondary transfer backup roller 4 and the tension roller 5, a belt such as the intermediate transfer belt 3, a rotator inclination unit such as the belt alignment unit 50, a belt tension adjuster such as the retraction mechanism 70, and a descent stopper such as the descent stopper 42. The belt is looped around the plurality of support rotators and moves in accordance with rotation of the plurality support rotators. The rotator inclination unit inclines a rotation axis of a first support rotator such as the tension roller 5 that is one of the plurality support rotators with respect to a rotation axis of another support rotator such as the secondary transfer backup roller 4. The belt tension adjuster adjusts tension of the belt. The descent stopper such as the descent stopper 42 prevents the first support rotator from descending.

With this configuration, as described in the above embodiment, for example, when the tension adjuster relaxes the tension of the belt for the purpose of preventing the curling and the force acting on the first support rotator varies, even if a force for lowering the first support rotator occurs, the descent stopper such as the descent stopper 42 can prevent the first support rotator from descending. Accordingly, it is possible to prevent problems caused by descent of the first support rotator in a configuration in which the first support rotator is inclined with respect to another support rotator.

Aspect B

In the belt device according to the aspect A, when the belt is drawn to one side of the first support rotator in the axial direction, the rotator inclination unit such as the belt alignment unit 50 is configured to incline the first support rotator to move the belt in a direction opposite to the one side of the first support rotator.

With this configuration, as described in the above embodiment, the rotator inclination unit inclines the first support rotator, thereby eliminating the belt deviation and correcting belt walk.

Aspect C

In the belt device according to Aspect A, the belt tension adjuster such as the retraction mechanism 70 moves a second support rotator such as the entry roller 7, which is another of the plurality of support rotators, in a direction perpendicular to the rotation axis of the second support rotator to adjust tension of the belt.

With this configuration, as described in the above embodiment, the belt tension adjuster moves the second support rotator to reduce the belt tension at timing other than the time of image formation. Therefore, the curling of the belt can be prevented.

Aspect D

In the belt device according to Aspect C, the belt tension adjuster keeps at least some tension on the belt even when the second support rotator is moved to a position where the belt tension adjuster weakens the tension of the belt.

With this configuration, as described in the above embodiment, it is possible to prevent the belt such as the intermediate transfer belt 3 from loosening and interfering with surrounding components.

Aspect E

An intermediate transfer device such as the intermediate transfer device 60 includes the belt device according to the Aspect A. The belt such as the intermediate transfer belt 3 is configured to bear a visible image such as a toner image transferred from an image bearer and transfer the visible image onto a recording medium P.

With this configuration, as described in the above embodiment, the intermediate transfer device prevents damage to the belt such as the intermediate transfer belt 3 caused by descent of the support rotator.

Aspect F

An image forming apparatus such as the printer 100 includes the belt device according to the aspect A.

With this configuration, as described in the above embodiment, the image forming apparatus prevents damage to the belt or surrounding components.

Aspect G

In the image forming apparatus according to Aspect F, the descent stopper such as the descent stopper 42 is configured to prevent a component of the belt device from contacting another device around the belt device.

With this configuration, as described in the above embodiment, the image forming apparatus prevents damage to the component of the belt device or surrounding components around the belt device.

Aspect H

In the image forming apparatus according to Aspect F, the belt device is configured to removably installed in an apparatus body of the image forming apparatus. The belt is an intermediate transfer belt such as the intermediate transfer belt 3 configured to bear a visible image transferred from an image bearer and transfer the visible image onto a recording medium. The belt device is installed in and removed from the apparatus body in a state in which the intermediate transfer belt such as the intermediate transfer belt 3 separates from the image bearer and the belt tension adjuster weakens the tension of the belt.

With this configuration, as described in the above embodiment, the state of the belt device in transportation is same as the state for the installation and removal to the apparatus body, and operability of the installation and removal can be improved.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A belt device comprising:

a plurality of support rotators including a first support rotator and a second support rotator;

a belt looped around the first support rotator and the second support rotator and rotated by rotation of the plurality of support rotators;

a rotator inclination unit to incline a rotation axis of the first support rotator relative to a rotation axis of the second support rotator, the rotator inclination unit including a support to movably support the first support rotator in a vertical direction;

a belt tension adjuster to move the second support rotator between a tension applied position to apply tension to the belt and a tension relaxed position to relax the tension of the belt; and a descent stopper to prevent the first support rotator from descending, the descent stopper to restrict the first support rotator in the vertical direction in a state in which the belt tension adjuster has moved the second support rotator to the tension relaxed position.

2. The belt device according to claim 1, wherein, when the belt is drawn toward a first side of the first support rotator in an axial direction of the first support rotator, the rotator inclination unit inclines the first support rotator to move the belt to a second side of the first support rotator opposite to the first side in the axial direction.

3. The belt device according to claim 1, wherein the belt tension adjuster moves a second support rotator that is one of the plurality of support rotators in a direction perpendicular to a rotation axis of the second support rotator to adjust tension of the belt.

4. The belt device according to claim 3, wherein the belt tension adjuster keeps at least some tension on the belt even if the second support rotator is moved to a position where the belt tension adjuster weakens the tension of the belt.

5. An intermediate transfer device comprising:

the belt device according to claim 1, the belt serving as an intermediate transfer belt configured to bear a visible image transferred from an image bearer and transfer the visible image onto a recording medium.

6. An image forming apparatus comprising:

an image bearer to bear a visible image; and the belt device according to claim 1 to bear the visible image transferred from the image bearer.

7. The image forming apparatus according to claim 6, wherein the descent stopper is configured to prevent a component of the belt device from contacting another device around the belt device.

8. The image forming apparatus according to claim 6, wherein the belt device is configured to be removably installed in an apparatus body of the image forming apparatus, wherein the belt is an intermediate transfer belt configured to bear the visible image transferred from the image bearer and transfer the visible image onto a recording medium, and wherein the belt device is installed in and removed from the apparatus body in a state in which the intermediate transfer belt separates from the image bearer and the belt tension adjuster weakens the tension of the belt.

9. The belt device according to claim 1, wherein in a state in which the belt tension adjuster has moved the second support rotator to the tension relaxed position, the first support rotator is displaced lower than when the second support rotator is at the tension applied position.

10. The belt device according to claim 1, wherein the descent stopper extends from a bottom of the rotator inclination unit in an axial direction of the first support rotator and is configured to prevent the first support rotator from descending as a force for lifting the first support rotator decreases from adjusting the tension of the belt.

* * * * *